US011746511B2

(12) United States Patent
Schmitt et al.

(10) Patent No.: US 11,746,511 B2
(45) **Date of Patent: *Sep. 5, 2023**

(54) CONFIGURABLE FAUCET APPARATUS AND METHODS OF IMPLEMENTING AND OPERATING SAME

(71) Applicant: INSINKERATOR LLC, Benton Harbor, MI (US)

(72) Inventors: Matthew A. Schmitt, Kenosha, WI (US); Gregory Chesack, Kenosha, WI (US); Mauricio Medaets, Milwaukee, WI (US)

(73) Assignee: INSINKERATOR LLC, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/532,498

(22) Filed: Nov. 22, 2021

(65) Prior Publication Data

US 2022/0081884 A1 Mar. 17, 2022

Related U.S. Application Data

(63) Continuation of application No. 17/061,214, filed on Oct. 1, 2020, now Pat. No. 11,203,857.

(Continued)

(51) Int. Cl.
*E03C 1/04* (2006.01)
*E03C 1/05* (2006.01)

(52) U.S. Cl.
CPC ..... *E03C 1/0404* (2013.01); *E03C 1/057* (2013.01)

(58) Field of Classification Search
CPC .... E03C 1/0401; E03C 1/0402; E03C 1/0403; E03C 1/0404; E03C 1/057; E03C 1/042; E03C 2001/0414
See application file for complete search history.

(56) References Cited

U.S. PATENT DOCUMENTS

D288,835 S 3/1987 Yost
4,735,357 A 4/1988 Gregory et al.
(Continued)

FOREIGN PATENT DOCUMENTS

CN 201630549239 11/2016
WO 2015010251 A1 1/2015

OTHER PUBLICATIONS

PCT/US2020/053853 International Search Report and Written Opinion of the International Searching Authority dated Dec. 22, 2020 (13 pages).

(Continued)

*Primary Examiner* — Janie M Loeppke
(74) *Attorney, Agent, or Firm* — Amundsen Davis, LLC

(57) ABSTRACT

A faucet apparatus and method of implementing a faucet apparatus are disclosed herein. In an example embodiment, the apparatus includes a body integrated or coupled to a base, where the body includes surfaces within which are formed first and second orifices that respectively extend inward into the body along first and second axes, respectively. A first cross-section of the first orifice taken perpendicular to the first axis has a first size and a first shape that are, respectively, substantially identical to a second size and a second shape of a second cross-section of the second orifice taken perpendicular to the second axis. The apparatus also includes a spout having a first end supported within the first orifice, and a sensor structure having a cross-sectional surface supported within the second orifice, where each of the first end and cross-sectional surface is configured to fit complementarily within either of the orifices.

20 Claims, 20 Drawing Sheets

Related U.S. Application Data

(60) Provisional application No. 62/950,711, filed on Dec. 19, 2019.

(56) References Cited

U.S. PATENT DOCUMENTS

| | | | | |
|---|---|---|---|---|
| D329,083 | S | 9/1992 | Dannenberg | |
| D346,013 | S | 4/1994 | Mckeone | |
| D440,284 | S | 11/2001 | Pitsch | |
| D467,643 | S | 12/2002 | Otero | |
| D468,398 | S | 1/2003 | Ziemann | |
| D473,630 | S | 4/2003 | Wettstein | |
| D510,126 | S | 9/2005 | Ouyoung | |
| D515,665 | S | 2/2006 | Ng | |
| D515,666 | S | 2/2006 | Ng | |
| D571,893 | S | 6/2008 | Celli | |
| D581,492 | S | 11/2008 | Schoenherr | |
| 7,650,653 | B2 | 1/2010 | Johnson et al. | |
| D635,221 | S | 3/2011 | Rubin | |
| D667,087 | S | 9/2012 | Shieh | |
| 8,448,271 | B2 | 5/2013 | Rudisser | |
| D712,011 | S | 8/2014 | Du | |
| 9,157,772 | B2 | 10/2015 | Santos et al. | |
| D754,294 | S | 4/2016 | Garland | |
| 9,429,246 | B2 | 8/2016 | Chen et al. | |
| D803,989 | S | 11/2017 | Flowers | |
| 9,856,635 | B1 | 1/2018 | Liu | |
| D844,111 | S | 3/2019 | Soulier | |
| 10,301,799 | B2 | 5/2019 | Thompson et al. | |
| 10,323,393 | B2 | 6/2019 | Thompson et al. | |
| D863,507 | S | 10/2019 | Zhang | |
| D914,847 | S | 3/2021 | Zhang | |
| 2006/0157109 | A1 | 7/2006 | Vu | |
| 2008/0277611 | A1* | 11/2008 | Esche | F16K 31/602 137/625 |
| 2010/0043898 | A1* | 2/2010 | Eckhaus | F16K 19/006 137/625 |
| 2016/0122982 | A1 | 5/2016 | Wang | |
| 2019/0194917 | A1 | 6/2019 | Wang | |
| 2019/0277012 | A1 | 9/2019 | Hamann | |
| 2020/0123741 | A1 | 4/2020 | Huang | |
| 2021/0189703 | A1 | 6/2021 | Schmitt et al. | |

OTHER PUBLICATIONS

Amazon, Ibergrif M16357 Wall Mounted Kitchen Tap, posted Nov. 18, 2019, [online], [visited Apr. 6, 2022]. Internet, <URL https://www.amazon.co.uk/Ibergrif-M16357-Mounted-Kitchen-Chronne/dp/B081HFLGZ3/ref> (Year: 2019).

Amazon, Yijie Kitchen Sink Faucets 360 Rotatable Single Lever Tap, posted Sep. 5, 2019, [online], [visited Apr. 6, 2022]. Internet, < URL: https://www.amazon.co.uk/Ibergrif-M16357-Mounted-Kitchen-Chronne/dp/B081HFLGZ3/ref> (Year 2019).

Amazon, Wifehelper Household Kitchen Faucet Single Gold Wall-Mounted Faucet, posted Dec. 4, 2019, [online], [visited Apr. 6, 2022]. Internet, <URL: https://www.amazon.com/dp/B07YD51F2R/ref> (Year: 2019).

EP Communication Pursuant 161 and 162; PCT/US2020/053853; dated Jun. 29, 2022 (2 pages).

Response to EP Communication Pursuant 161 and 162; PCT/US2020/053853; dated Jul. 26, 2022 (3 pages).

* cited by examiner

FIG. 7
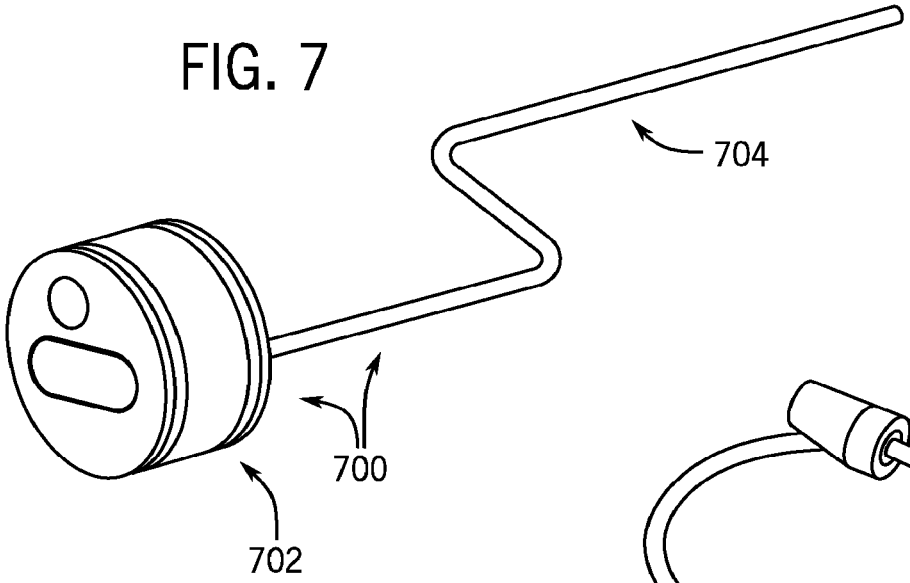
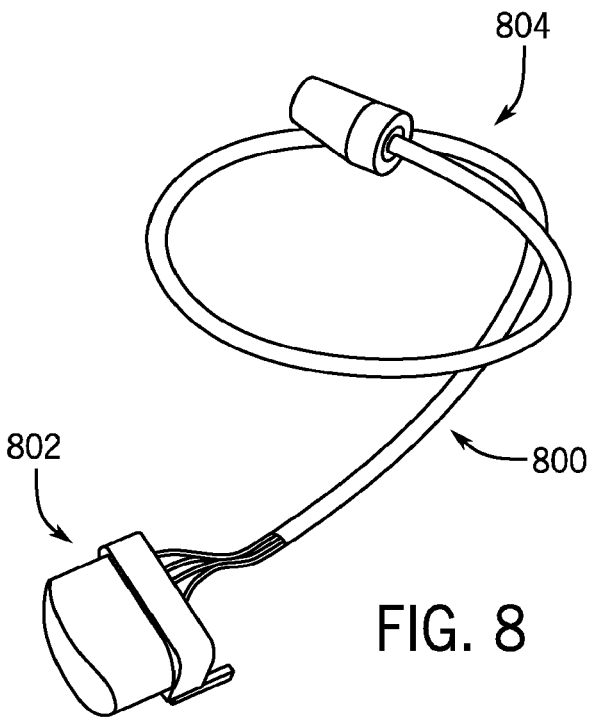
FIG. 8
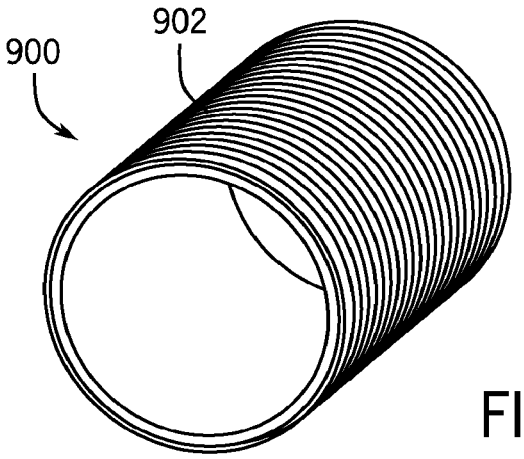
FIG. 9

2-HOLE / 3-HOLE

2-HOLE / 3-HOLE

CONFIGURABLE FAUCET APPARATUS AND METHODS OF IMPLEMENTING AND OPERATING SAME

FIELD

The present disclosure relates to water, fluid, or liquid dispensing apparatuses and methods of implementing and operating same and, more particularly, to faucet apparatuses and related methods of implementation and operation.

BACKGROUND

Handwashing faucets are common in commercial kitchen applications. Such faucets are often installed on small stainless steel sinks. Such faucets often are equipped with, or operable in combination with, any of a variety of actuation mechanisms that allow for controlling whether the faucets dispense water (e.g., whether the faucets are on or off), the flow rate of the water being dispensed, or the temperature of the water being dispensed (e.g., if the faucet allows for hot or cold water to be dispensed from the same port from the faucet). Actuation mechanisms that are available for use in combination with or as part of such faucets can include, for example, hot and cold handles or levers, push bars, foot pedals, or hands-free proximity sensor-activated solenoids.

Conventional commercial handwashing faucets are typically designed to be suitable for being mounted in relation to specific types of sink basin arrangements. In general, there exist today two different styles of sink basin arrangements, namely, deck mount sink basin arrangements and backsplash mount sink basin arrangements, Prior Art examples of which are respectively shown in FIG. 1 and FIG. 2. As shown in FIG. 1, a deck mount sink basin arrangement 100 includes a sink basin 102 and a horizontal rim wall 103 with a horizontal surface 104 extending around the sink basin, where the horizontal rim wall (and surface 104 thereof) includes one or more holes 106. In the case of the deck mount sink basin arrangement 100, a conventional faucet (not shown in FIG. 1) can be implemented by mounting the faucet on the horizontal surface 104, over the holes 106, so that the faucet is supported upon that horizontal surface. The holes 106 both allow the faucet to be secured to the deck mount sink basin arrangement 100, and also allow for water and, in at least some cases, electricity to be routed (e.g., by one or more tubes, pipes, cables, or wires) to the faucet from sources external to the sink basin arrangement.

By contrast, as shown in FIG. 2, a backsplash mount sink basin arrangement 200 includes a sink basin 202 and a horizontal surface 204 extending around the sink basin, and additionally includes a vertical sink wall 205 including a vertical sink wall surface (or lip) 206 that extends upward from a rear edge 208 of the horizontal surface. In this arrangement, it is the vertical sink wall 205 (and surface 206 thereof, which serves as a backsplash for the sink) that includes one or more holes 210. In the case of the backsplash mount sink basin arrangement 200, a conventional faucet (again not shown in FIG. 2) can be implemented by mounting the faucet on the vertical sink wall 205, against the vertical sink wall surface 206 and over the holes 210, so that the faucet is supported upon that vertical sink wall surface. As with the holes 106, the holes 210 both allow the faucet to be secured to the backsplash mount sink basin arrangement 200, and also allow for water and, in at least some cases, electricity to be routed (e.g., by one or more tubes, pipes, cables, or wires) to the faucet from sources external to the sink basin arrangement.

It should additionally be appreciated that, although FIG. 1 shows the deck mount sink basin arrangement 100 as having three of the holes 106 and although FIG. 2 shows the backsplash mount sink basin arrangement 200 as having two of the holes 210, both conventional deck mount sink basin arrangements and also conventional backsplash mount sink basin arrangements can have any of several different mounting hole configurations depending upon the embodiment. Typically, such configurations will entail one hole, two holes, or three holes (most handwash sink basin arrangements have either one or two hole configurations, although three hole configurations are also possible). When a sink basin arrangement is configured to have two holes as shown for example in FIG. 2, the two holes are typically arranged to have four-inch (4") on center spacing—that is, the respective center axes of the two holes are spaced apart by two inches on opposite sides, respectively, of a center point that is positioned along a straight line connecting those two center axes. Additionally, when a sink basin arrangement is configured to have three holes as shown for example in FIG. 1, the third hole is typically positioned midway between the two other holes, which again are typically arranged to have four-inch (4") on center spacing, with the third hole being at the center—that is, the respective center axes of all three of the holes are positioned along a straight line, with each of two of the holes being spaced apart by two inches on opposite sides, respectively, of the center axis of the third hole.

To accommodate the existence of both deck and backsplash mount sink basin arrangements, as well as the multiplicity of hole arrangements that are available in connection with those different sink basin arrangements, to date the market has responded by making available a variety of specific conventional faucet models that are respectively suitable for implementation in conjunction with particular one(s) of the sink basin arrangements. In some cases, such conventional faucet models are particularly configured to be implemented in relation to a specific type of sink basin arrangement (e.g., one or the other of the deck and backsplash mount sink basin arrangements) having a particular hole arrangement (e.g., one, two, or three holes). In some additional cases, such conventional faucets are configured to be implemented by way of an additional (separate) adaptor plate. All of this results in customers potentially, and inconveniently, needing multiple faucet models to allow for faucets to be implemented in relation to (or to cover) the various sink basin arrangement options. This is especially true with chain customers, which can have multiple facilities in which several or all of the various sink basin arrangements are present.

Another problem that exists in relation to commercial handwash systems is that there can be a delay, sometimes significant, in terms of the time required for warm water to reach a faucet outlet after a user has turned on (or the faucet has otherwise been commanded to provide) the warm water. Although most of this time delay can be attributed to the distance between a faucet and the water heating device from which warm water is being provided, some of the delay can be attributed to heat loss through the faucet itself, and/or the amount of water in the faucet upstream from the valve in the spout. In order for the spouts to be robust and provide room for hands and arms beneath the faucets, the spouts often have larger diameters and are relatively long. With such a configuration, water tends to be retained within the spouts after the water flow is shut off and such water, which cools off after the valve is closed, must be purged from the faucet when the valve is later opened before warm water is emitted from the spout. Thus, upon a user turning on a faucet (or upon a faucet being otherwise commanded to provide water water), there is a period of time where the water output is below the desired temperature.

Accordingly, it would be advantageous if an improved faucet apparatus and/or method could be developed that alleviated or addressed one or more of the above-discussed concerns relating to conventional faucets or faucet implementations, and/or alleviated or addressed one or more other concerns or disadvantages, and/or provided one or more advantages by comparison with conventional arrangements.

BRIEF SUMMARY

In at least some example embodiments, the present disclosure relates to a faucet apparatus that includes a base having a mounting surface, and a body integrated or coupled to the base. The body includes first and second surfaces, respectively, within which are formed first and second orifices, respectively. Also, the first and second orifices respectively extend inward into the body along a first axis and a second axis, respectively, and the first axis is perpendicular or substantially perpendicular relative to the second axis. Further, a first cross-section of the first orifice taken perpendicular to the first axis has a first size and a first shape that are, respectively, substantially identical to a second size and a second shape of a second cross-section of the second orifice taken perpendicular to the second axis. Additionally, the faucet apparatus also includes a spout having a first end that is configured to fit complementarily within either of the first and second orifices, and that is supported within the first orifice, and a sensor structure having an external cross-sectional surface that also is configured to fit complementarily within either of the first and second orifices, and that is supported within the second orifice.

In at least some additional embodiments, the present disclosure relates to a method of implementing a faucet apparatus. The method includes providing a plurality of components of the faucet apparatus, including a base, a body, a spout, and a sensor structure. The body is integrated or coupled to the base, the base includes a mounting surface, and the body includes first and second surfaces, respectively, within which are formed first and second orifices, respectively. Also, the first and second orifices respectively extend inward into the body along a first axis and a second axis, respectively, and the first axis is perpendicular or substantially perpendicular relative to the second axis. Additionally, a first cross-section of the first orifice taken perpendicular to the first axis has a first size and a first shape that are, respectively, substantially identical to a second size and a second shape of a second cross-section of the second orifice taken perpendicular to the second axis. Further, the spout has a first end that is configured to fit complementarily within either of the first and second orifices, and the sensor structure has an external cross-sectional surface that also is configured to fit complementarily within either of the first and second orifices. Additionally, the method further includes determining whether a structure in relation to which the mounting surface is to be in contact and supported includes a horizontally-extending support surface or a vertically-extending support surface. Further, the method also includes either: (a) if the mounting surface includes the horizontally-extending support surface, inserting the first end into the first orifice and inserting the sensor structure into the second orifice; or (b) if the mounting surface includes the vertically-extending support surface, inserting the first end into the second orifice and inserting the sensor structure into the first orifice, whereby the faucet apparatus can be implemented in either of two manners so that the sensor structure is forward-facing, or substantially forward-facing, regardless of whether the structure includes the horizontally-extending support surface or the vertically-extending support surface.

In at least some further embodiments, the present disclosure relates to a faucet apparatus including a spout, a sensor structure having a line-of-sight axis associated therewith, a base including a mounting surface that extends at least partly along a plane, and means for enabling the spout and the sensor structure to be supported in relation to the base in either of a first manner or a second manner. When the spout and the sensor structure are supported in relation to the base in the first manner, the line-of-sight axis is normal or substantially normal relative to the plane and, when the spout and the sensor structure are supported in relation to the base in the second manner, the line-of-sight axis is parallel or substantially parallel to the plane.

BRIEF DESCRIPTION OF THE DRAWINGS

Embodiments of faucets (or faucet apparatuses), or systems or arrangements employing such faucets, and/or related methods of implementation or operation, are disclosed with reference to the accompanying drawings and are for illustrative purposes only. The faucets, systems, arrangements, and methods encompassed herein are not limited in their applications to the details of construction, arrangements of components, or other aspects or features illustrated in the drawings, but rather such faucets, systems, arrangements, and methods encompassed herein include other embodiments or are capable of being practiced or carried out in other various ways. Like reference numerals are used to indicate like components. In the drawings:

FIG. 7 is a front perspective view of a sensor structure portion of the improved faucet apparatus, of which portions are also shown in FIG. 3, FIG. 4, FIG. 5, and FIG. 6;

FIG. 8 is a perspective view of an example commercially-available sensor structure that can be implemented as or as part of the sensor structure portion of FIG. 7, and that particularly includes a proximity sensor therein;

FIG. 9 is a perspective view of a threaded sleeve portion of the improved faucet apparatus, of which portions are also shown in FIG. 3, FIG. 4, FIG. 5, FIG. 6, and FIG. 7;

DETAILED DESCRIPTION

The present disclosure envisions a variety of faucet (or faucet apparatus) embodiments and arrangements that are configurable or reconfigurable to allow for the overall faucet to be implemented in different manners, particularly so that the faucet can be mounted in different environments that entail either a horizontally-extending support surface, such as in a deck mount sink basin arrangement, or a vertically-extending support surface, such as in a backsplash mount sink basin arrangement. In at least some embodiments encompassed herein, the faucets are configurable or reconfigurable not only to suit environments entailing each of horizontally-extending and vertically-extending support surfaces, but also environments in which the support surfaces entail any of single-hole, two-hole, or three-hole mounting configurations that allow for the mounting of the faucets to the support surfaces. At least some such embodiments of faucets encompassed herein can be considered to be "universal mount" (or substantially universal mount) faucets insofar as the faucet can address multiple mounting environments or configurations that are the most common types of commercially-available mounting environments or configurations for faucets. Additionally, the present disclosure envisions a variety of different methods of implementation of such faucets, as well as methods of operating such faucets.

Figure 3:
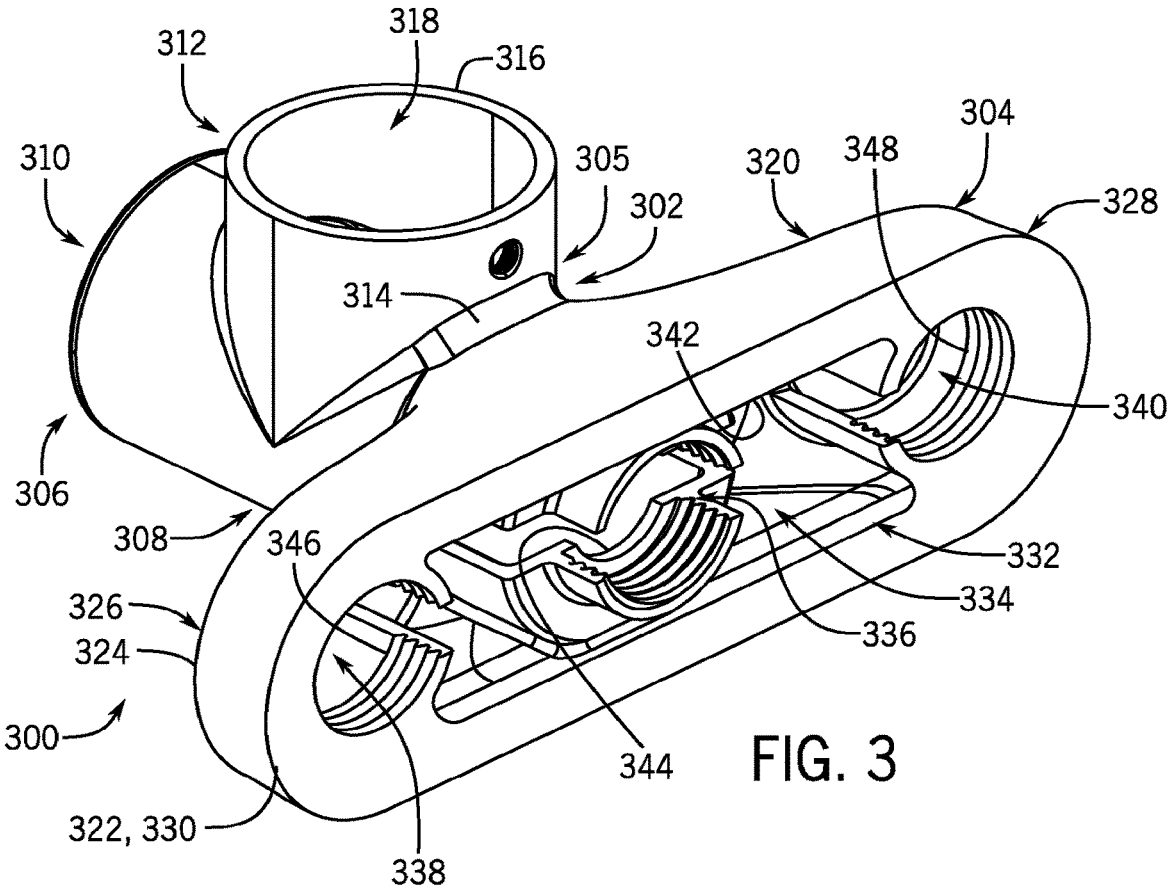
FIG. 3 is a first perspective view of portions of an improved faucet apparatus, including a body portion and a base portion, in accordance with a first example embodiment encompassed herein.
Figure 4:
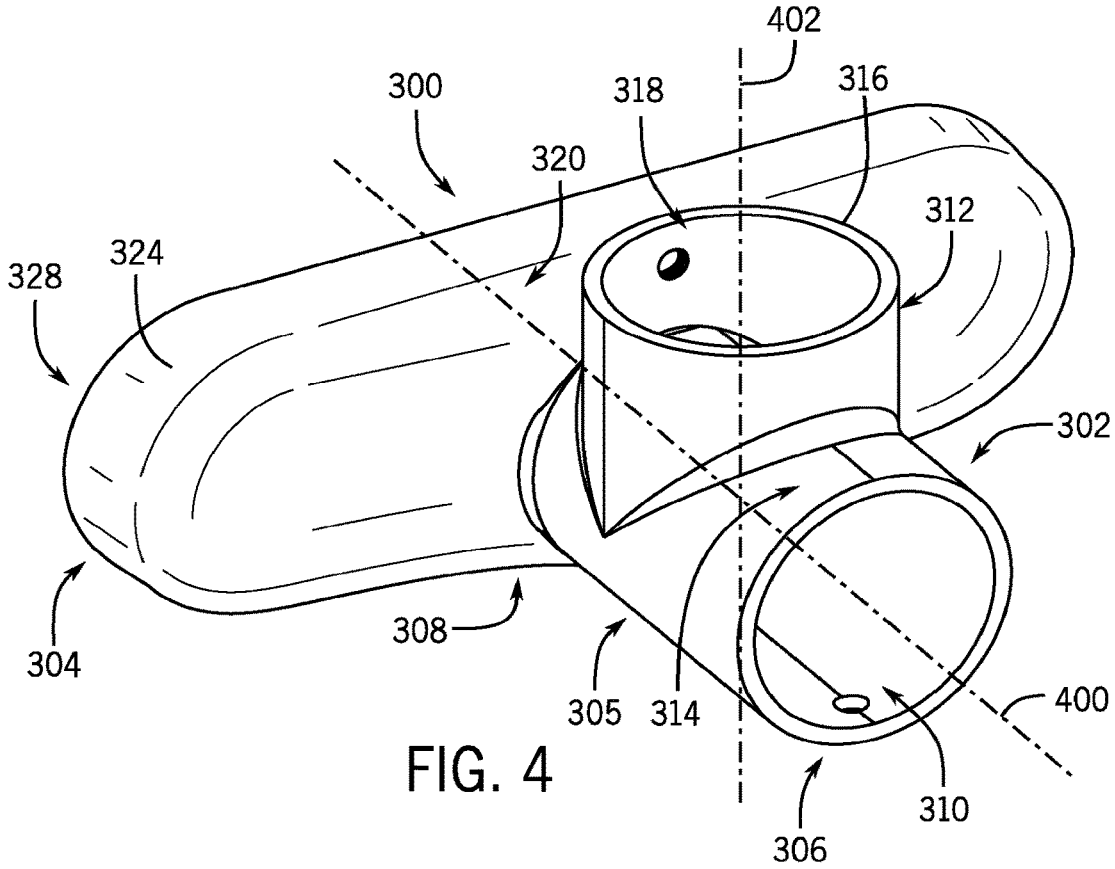
FIG. 4 is a second perspective view of the portions of the improved faucet apparatus of FIG. 3, where the second perspective view is taken from an orientation that is opposite to an orientation from which the first perspective view of FIG. 3 is taken.

Referring to FIG. 3 and FIG. 4, first and second perspective views of faucet portions 300 in accordance with a first embodiment of a faucet (or faucet apparatus) encompassed herein are shown, respectively. It will be appreciated that the first perspective view of the faucet portions 300 of FIG. 3 is oppositely directed relative to the second perspective view of FIG. 4. As shown, the faucet portions 300 include a faucet body 302 and a faucet base 304 that are, in this embodiment, integrally formed with one another. The faucet body 302 includes a primary tubular section 305 that extends between a first end 306 and a second end 308. The second end 308 is integrally formed with the faucet base 304. In contrast, at the first end 306, a first orifice (or female body cavity) 310 is formed. Additionally, the faucet body 302 further includes a tubular extension 312 that extends perpendicularly outward from a first side 314 of the primary tubular section 305, up to a third end 316, at which is formed a second orifice (or female body cavity) 318.

In the present embodiment, the first end 306 can be considered a first side surface of the faucet body 302 and the third end 316 can be considered a second side surface of the faucet body 302, and the two side surfaces extend perpendicularly or substantially perpendicularly relative to one another. Additionally, as is particularly evident from FIG. 4, the first orifice 310 extends inwardly from the first end 306 into the faucet body 302 along a first axis 400, and the second orifice 318 extends inwardly from the third end 316 into the faucet body 302 along a second axis 402. In the present embodiment, the first axis 400 and the second axis 402 extend perpendicularly (or substantially perpendicularly) relative to one another, albeit the present disclosure is intended to encompass other relative arrangements of such axes as well.

In the present embodiment, the first orifice 310 and second orifice 318 have identical design characteristics in at least certain respects. More particularly, in the present embodiment, each of the first orifice 310 and the second orifice 318 are cylindrical. Further, the size and shape of the first orifice 310, taken along a first cross-section perpendicular to the first axis 400 that in the present embodiment corresponds to the first end (or first side surface) 306, are respectively identical to the size and shape of the second orifice 318, taken along a second cross-section perpendicular to the second axis 402 that in the present embodiment corresponds to the third end (or second side surface) 316.

As additionally shown in FIG. 3, the faucet base 304 is an oblong structure having a first side 320 and a second side 322 that are connected with one another by an outer wall 324 and that generally extend outward beyond the circumference of the primary tubular section 305 in each of two diametrically-opposed directions, toward a first end 326 and a second end 328. The first side 320 is integrally joined with (or attached to) the second end 308 of the primary tubular section 305 of the faucet body 302, and the second side 322 includes a mounting edge or surface 330 that is intended to be in contact with a support surface such as provided by the deck mount or backsplash mount sink basin arrangements 100 and 200 shown above in FIG. 1 and FIG. 2.

It should be appreciated from FIGS. 3 and 4 that, in the present embodiment, the first axis 400 extends in a manner that is normal (or substantially normal) relative to the mounting surface 330. Therefore, given that the first axis 400 and second axis 402 are perpendicular (or substantially perpendicular) relative to one another as discussed above, it should be recognized that the first orifice 310 can be considered to be opposite the mounting surface 330 and that the second orifice 318 can be considered perpendicular or at 90° relative to (or substantially perpendicular) to the mounting surface 330. Relatedly, in the present embodiment, the first end (or first side surface) 306 of the faucet body 302 is parallel or substantially parallel to the mounting surface 330, and the third end (or second side surface) 316 is perpendicular or substantially perpendicular to the mounting surface 330.

Additionally, the mounting surface 330 defines an oblong orifice 332 that leads from a region exterior of the faucet base 304 into an interior 334 of the faucet base. The oblong orifice 332 as defined by the mounting surface 330 and the interior 334 both extend substantially the entire distance between the first end 326 and the second end 328 of the faucet base 304. Further, to permit the faucet to be mounted in relation to a variety of different sink basin arrangements having multiple different mounting hole options (e.g., with one, two, or three holes for mounting), the oblong orifice 332 and interior 334 include portions that take the form of first, second, and third holes 336, 338, and 340 extending inward into the interior 334 from the region exterior of the faucet base 304. The first hole 336 particularly is centered within the faucet base 304 such that a central axis of that hole is aligned or substantially aligned with the first axis 400. By contrast, the second and third holes 338 and 340 respectively are positioned between the first hole 336 and the first and second ends 326 and 328, respectively, and have central axes that are parallel or substantially parallel relative to the first axis 400.

The first, second, and third holes 336, 338, and 340 are positioned on a straight line, with the first hole being in the center and the second and third holes being positioned on each side of the first hole and being equally spaced apart from the first hole (in terms of the distances between the center axes of the neighboring holes) by, in this embodiment, two inches on either side. It should be appreciated further that, in the present embodiment, the first hole 336 is formed by way of inwardly-facing surfaces 342 and 344 of the outer wall 324, that the second hole 338 is formed by of an inwardly-facing surface 346 of the outer wall 324 proximate the first end 326, that the third hole 340 is formed by way of an inwardly-facing surface 348 of the outer wall proximate the second end 328.

Figure 5:
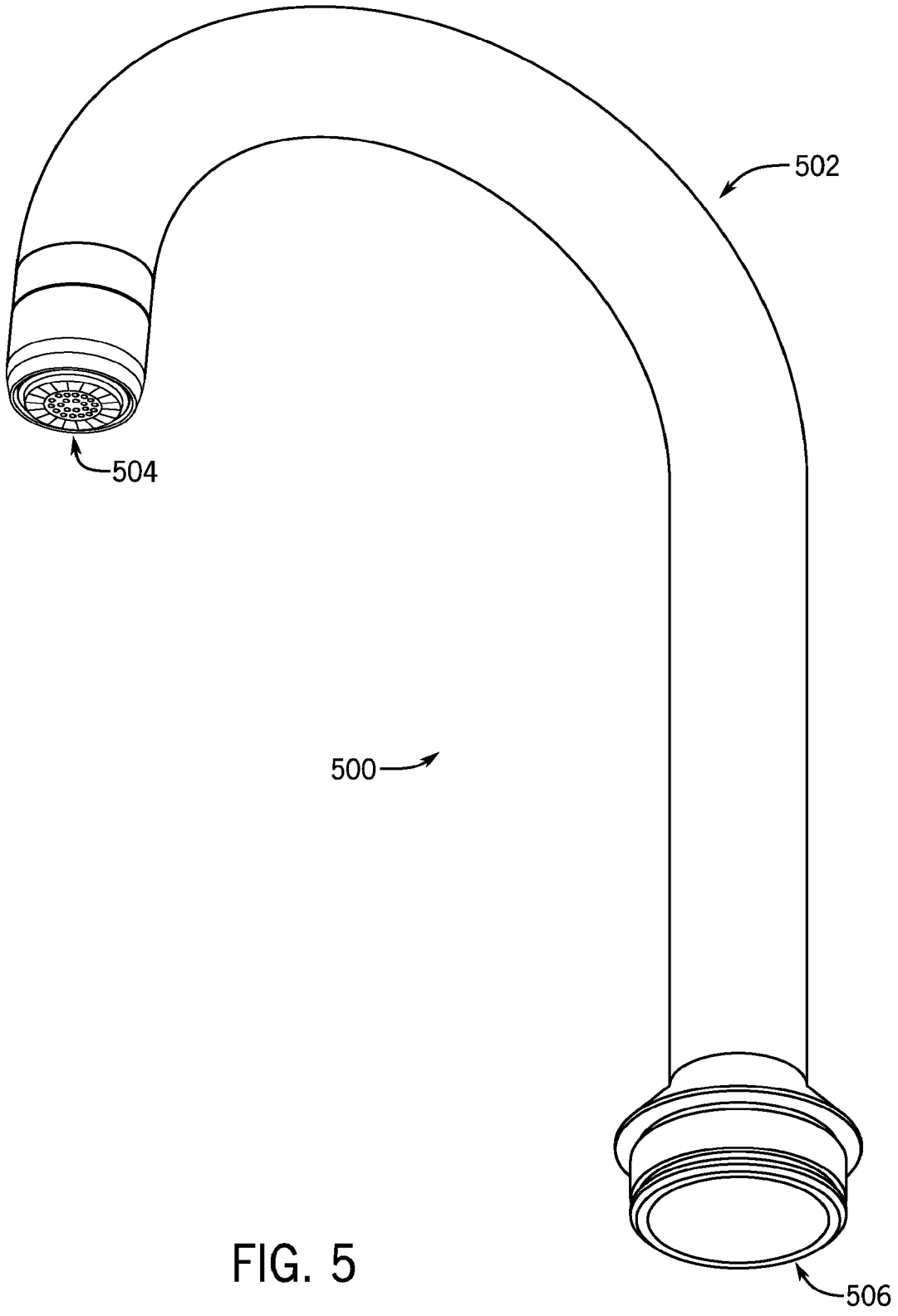
FIG. 5 is a perspective view of a spout portion of the improved faucet apparatus, of which portions are also shown in FIG. 3 and FIG. 4.

In addition to the faucet portions 300 shown in FIG. 3 and FIG. 4, the first embodiment of the faucet encompassed herein additionally includes further portions. Among these are a spout portion (or spout) 500 shown in FIG. 5. As shown, in the present embodiment, the spout portion 500 particularly includes a J-shaped (or 180 degree curved) tubular section 502 that extends between a first end 504 and a second end 506. The second end 506 can be considered an input end at which water (or another fluid or liquid) can be introduced into the spout portion 500, and the first end 504 can be considered an output or dispensing end at which water (or another fluid or liquid) can be emitted from the spout portion during operation of the faucet. In the present embodiment, the second end 506 is or includes a male cylindrical feature that particularly is configured to be entirely or substantially complementary, in terms of its size and shape, to the sizes and shapes of each of the first orifice 310 and second orifice 318 as described above (that is, the sizes and shapes of those orifices at each of the first end 306 and third end 316 of the faucet body 302).

Figure 6:
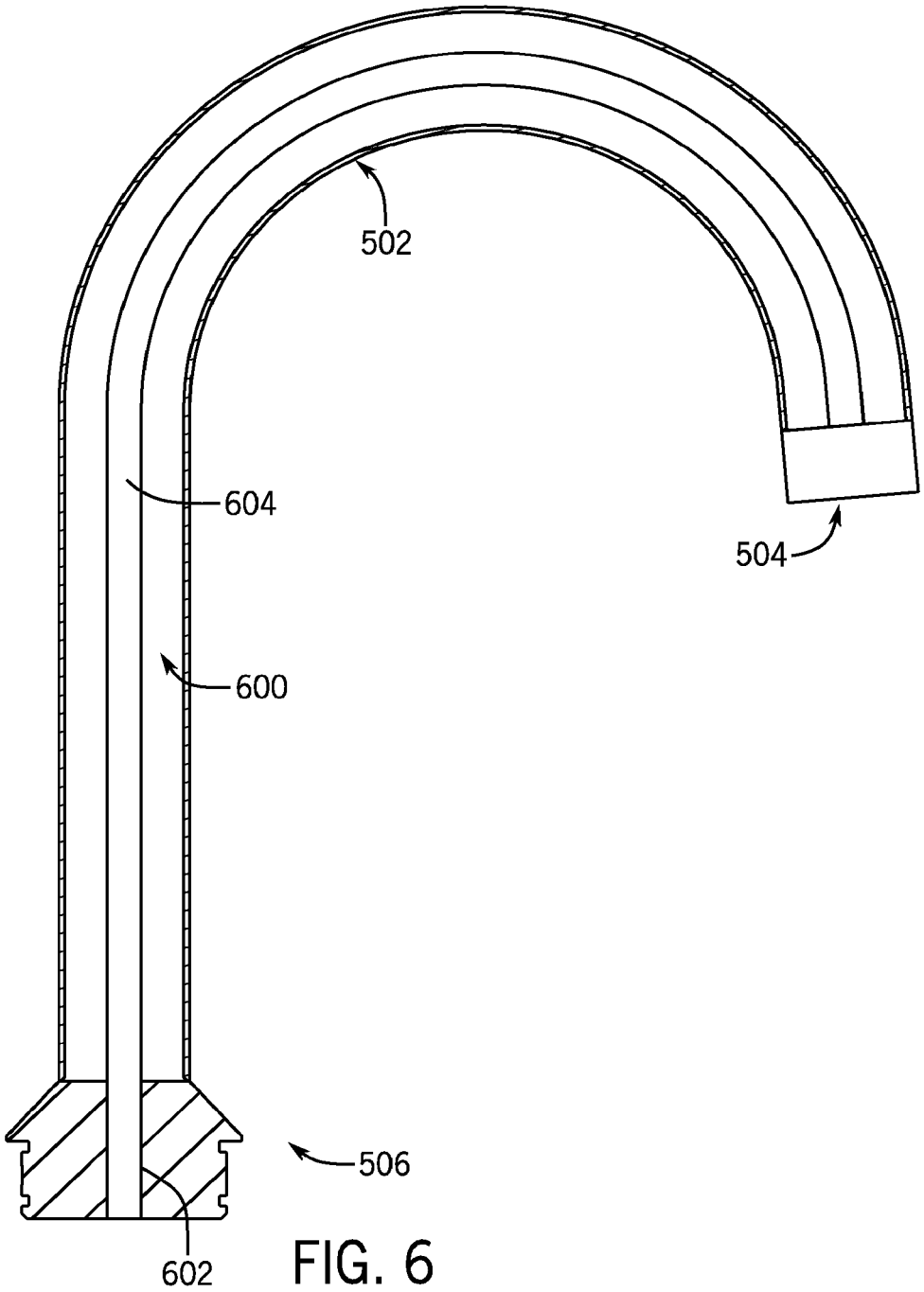
FIG. 6 is a cross-sectional view of the spout portion of FIG. 5, taken along a central axis extending through the spout portion.

Further, a cross-sectional view of the spout portion 500, taken along a central axis of the spout portion, is additionally provided in FIG. 6. As shown, in addition to including the J-shaped tubular section 502 extending between the first end 504 and second end 506, the spout portion additionally includes an internal channel 600 through which can flow water (or other fluid or liquid), particularly from the second end 506 to the first end 504. In the embodiment shown, a flow tube 602 is additionally positioned within and through the internal channel 600, which extends from a location outside of the spout portion 500, to the second end 506, and then through the internal channel 600 up to the first end 504. In this embodiment, it is actually an inner channel 604 within the flow tube 602 that is the channel within which water (or other fluid or liquid) can flow so as to be dispensed from the first end 504 of the spout portion 500.

The flow tube 602 can be considered, although need not be considered, an additional portion of the spout portion 500 and/or of the overall faucet of which the spout portion forms a part. In at least some embodiments, the flow tube 602 is additionally configured in an advantageous manner so as to address or reduce, by comparison with conventional faucets, delays in water outlet temperature. In particular, in some such embodiments, the flow tube 602 entails a small diameter tube within the spout portion, where the tube particularly has an inner diameter (in terms of the inner channel 604 within which water or other fluid/liquid flows) of less than one-quarter of an inch (<¼"). Use of a flow tube with such a small inner diameter particularly reduces the amount of water/fluid/liquid left inside the flow tube and the time to purge that water/fluid/liquid when the valve is opened. Additionally, by using a smaller tube inside the faucet, structural/aesthetic designs with larger diameter spouts can be used without there being an (undesirably) long delay in warm or hot water output when the water is first actuated to output warm or hot water. The small diameter tube also reduces the surface area in contact with the air around it and reduces the heat loss to the outside environment. In addition, by placing the flow tube within the spout portion 500, additional airspace is created, which further insulates the warm water from the outside air temperature.

Referring additionally to FIG. 7, the first embodiment of the faucet not only includes the faucet portions 300 and spout portion 500, but also includes a sensor structure portion 700. The sensor structure portion 700 shown in FIG. 7 is intended to encompass or be representative of any of a variety of embodiments, arrangements, or implementations. Nevertheless, in the present embodiment, the sensor structure portion 700 is a hands-free faucet sensor structure portion and can be designed to include, or support, a hands-free sensing device such as a proximity sensor. Further for example, envisioned at this time is the use of a common, commercially-available infrared (IR) proximity sensor as, or in conjunction with, the sensor structure portion 700. In such case, the sensor would operate by emitting IR light, which in turn would be reflected back to the sensor when an object (e.g., a user's hand) was in front of the sensor. Upon detecting such reflected light, the sensor would generate a signal that would be fed into a control module (not shown). The control module in turn would control, based upon the received signal, actuation of a solenoid (not shown) governing the opening or closing of a flow-control valve (not shown), and thus control the flow of water/fluid/liquid out of the faucet.

In the present embodiment, the sensor structure portion 700 includes a male cylindrical feature 702 that particularly is configured to be entirely or substantially complementary, in terms of its size and shape, to the sizes and shapes of each of the first orifice 310 and second orifice 318 as described above (that is, the sizes and shapes of those orifices at each of the first end 306 and third end 316). The sensor structure portion 700 can in some implementations include a custom lens into which sensor electronics are inserted. In other words, a custom lens can also be created with the male features (that a sensor, cable and connector could be installed into) that will directly mate with the either the first orifice 310 or second orifice 318. The sensor model 3580004 available from Chang Yi Shin Co., Ltd. of Lukang Township, Taiwan is an example of a conventional device that includes a sensor, lens with mounting features, cable and connector.

Additionally, the sensor structure portion 700 also includes, or is attached to, an electrical cable (or sensor wire) 704, by way of which electric power can be communicated to the sensor structure portion (or a sensor device therewithin) and/or sensor signals can be communicated from the sensor structure portion (or a sensor device therewithin) to another location. Depending upon the embodiment or implementation, an electrical cable such as the electrical cable 704 can be considered to constitute parts of the sensor structure portion 700 and/or the overall faucet, or instead can be considered to be an additional structure that is added to the sensor structure portion or faucet.

Further with respect to FIG. 7 and additionally with reference to FIG. 8, a perspective view (image) of a commercially-available sensor device 800 is shown in FIG. 8 that can serve as the sensor structure portion 700. In this example embodiment, the sensor device 800 includes a sensor head portion 802 that can constitute the male cylindrical feature 702. Additionally, the sensor device 800 also includes an electrical cable 804, which can be considered to correspond to the electrical cable 704 of FIG. 7.

Alternatively for example, the sensor structure portion 700 can in some implementations include an adapter structure (e.g., an annular structure) that is configured to accept and support thereon (or therewithin) a commercially-available sensor device, one example of which again can be the sensor device 800 in FIG. 8. In such an embodiment, the adapter structure would again have or constitute the male cylindrical feature 702 that particularly is configured to be entirely or substantially complementary, in terms of its size and shape, to the sizes and shapes of each of the first orifice 310 and second orifice 318 as described above. It should further be appreciated that, depending upon the embodiment or implementation, a commercially-available sensor device such as the sensor device 800 (or the sensor head portion 802 or electrical cable 804 thereof), and/or an adapter structure for supporting such a sensor device, can be considered to constitute parts of the sensor structure portion 700 or the overall faucet, or instead can be considered to be additional structures that are added to that sensor structure portion or faucet.

Further with respect to FIG. 9, in addition to the faucet portions described above with reference to FIGS. 3, 4, 5, 6, 7, and 8, the first embodiment of the faucet encompassed herein additionally includes one or more threaded sleeves 900, one of which is shown in FIG. 9. As will be described in further detail below, the threaded sleeve(s) 900 can be utilized, in at least some embodiments, to mount the faucet to a support structure such as a deck mount sink basin arrangement or a backsplash mount sink basin arrangement (for example, any of the arrangements shown in FIG. 1 or FIG. 2). In the present embodiment of FIG. 9, the threaded sleeve 900 is a tubular structure having threads 902 that are formed along an external cylindrical surface of the threaded sleeve.

Referring additionally to FIG. 3, the threaded sleeve 900 is configured, in terms of its diameter and the threads 902 (and the shape and size of those threads), to fit complementarily within any of first, second, and third holes 336, 338, and 340 formed within the faucet base 304. Correspondingly, all of the above-described inwardly-facing surfaces 342, 344, 346, and 348 are threaded in a manner that is complementary to the threads 902 of the threaded sleeve 900. Consequently, the threaded sleeve 900 of FIG. 9 can be screwed into (and thus attached to the faucet base 304 by way of) any of the first hole 336, second hole 338, or third hole 340. Additionally, one, two, or three of the threaded sleeves 900 can be screwed into (and attached to the faucet base 304 by way of) any one, two, or (all) three of the first hole 336, second hole 338, and third hole 340.

In the present embodiment of the faucet, the faucet body 302 is configured to allow for the connecting of both the spout portion 500 and the sensor structure portion 700 thereto in each of two relative arrangements, where the spout portion (or at least the second end 506 thereof) and sensor structure portion are positioned 90° apart in each of the two arrangements relative to one another. More particularly, because the first and second orifices 310 and 318 have identical design features (e.g., in terms of cross-sectional shape and size), the second end (or base) 506 of the spout portion 500 can fit equally well into each of the first orifice 310 or the second orifice 318 and, likewise, the male cylindrical feature 702 of the sensor structure portion 700 can fit equally well into each of the first orifice and second orifice. That is, each of the second end 506 and male cylindrical feature 702 of the spout portion 500 and sensor structure portion 700 are male features that are able to mate with either of the female features constituted by the first orifice 310 and the second orifice 318. Thus, the second end 506 of the spout portion 500 can be fit into a first one of the first and second orifices 310 and 318 when the male cylindrical feature 702 of the sensor structure portion 700 is fit into the other one of those orifices and, alternatively, the two portions can be interchanged such that the male cylindrical feature fits into the first one of those orifices and the second end 506 fits into the other of those orifices.

As mentioned above, the present disclosure encompasses faucet (or faucet apparatus) embodiments and arrangements that are configurable or reconfigurable to allow for the overall faucet to be implemented in different manners, particularly so that the faucet can be mounted in different environments or in relation to different support structures. Such different environments or support structures can include, among other things, horizontally-extending support surfaces such as in a deck mount sink basin arrangement, vertically-extending support surfaces such as in a backsplash mount sink basin arrangement, as well as varying embodiments of such horizontally-extending and vertically-extending support surfaces that have one, two, or three mounting holes. Turning to FIGS. 10-23, multiple views are provided to illustrate in particular how the faucet having the portions described above in regard to FIGS. 3, 4, 5, 6, 7, 8, and 9 is configurable (or reconfigurable) so as to be implemented in multiple different manners to suit multiple different environments/support structures.

Figure 1:
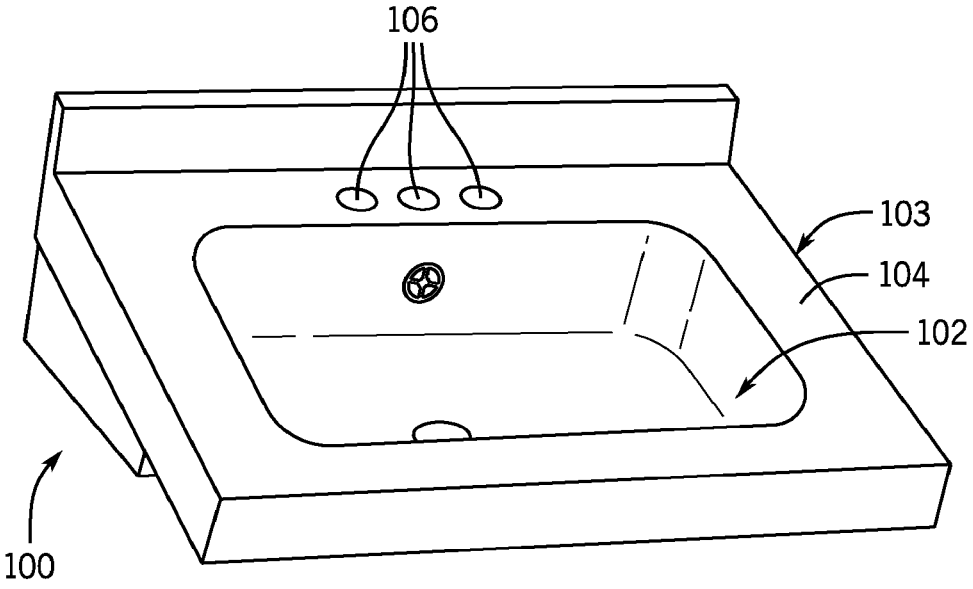
FIG. 1 PRIOR ART
FIG. 1 is a perspective view of an example Prior Art deck mount sink basin arrangement.

More particularly, FIGS. 10-23 show multiple views illustrating how the faucet having the faucet portions described in regard to FIGS. 3-9 can be configured and implemented in four different manners, so as to take on any of a first faucet implementation 1000, a second faucet implementation 1400, a third faucet implementation 1700, and a fourth faucet implementation 2100. In this regard, it should be appreciated that both of the first and second faucet implementations 1000 and 1400 are implementations that are suitable for mounting the faucet in relation to different forms of backsplash mount sink basin arrangements (one of which is shown in FIG. 2) and that both of the third and fourth faucet implementations 1700 and 2100 are implementations that are suitable for mounting the faucet in relation to different forms of deck mount sink basin arrangements (one of which is shown in FIG. 1).

It should be appreciated that the first, second, third, and fourth implementations 1000, 1400, 1700, and 2100 can be considered to be the same faucet insofar as each of the different implementations includes all of the faucet portions described above with respect to FIGS. 3-9, and those different implementations only vary from one another insofar as: (a) the different faucet portions (including the flow tube 602 and electrical cable 704) are arranged/assembled differently from one another in the different implementations; and/or (b) potentially different numbers of the one or more threaded sleeves 900 are included to allow for mounting of the faucet in relation to a sink basin arrangement. Also, although for purposes of the description relating to FIGS. 10-23 it can be assumed that the faucet employs an implementation of the sensor structure portion 700 that includes the commercially-available sensor device 800, it should be appreciated that the present disclosure is intended to encompass other implementations in which the sensor structure takes other forms such as those already discussed above. Notwithstanding the above comments, however, the first, second, third, and fourth implementations 1000, 1400, 1700, and 2100 can alternatively be referred to as different faucets given their different arrangements or features.

Figure 2:
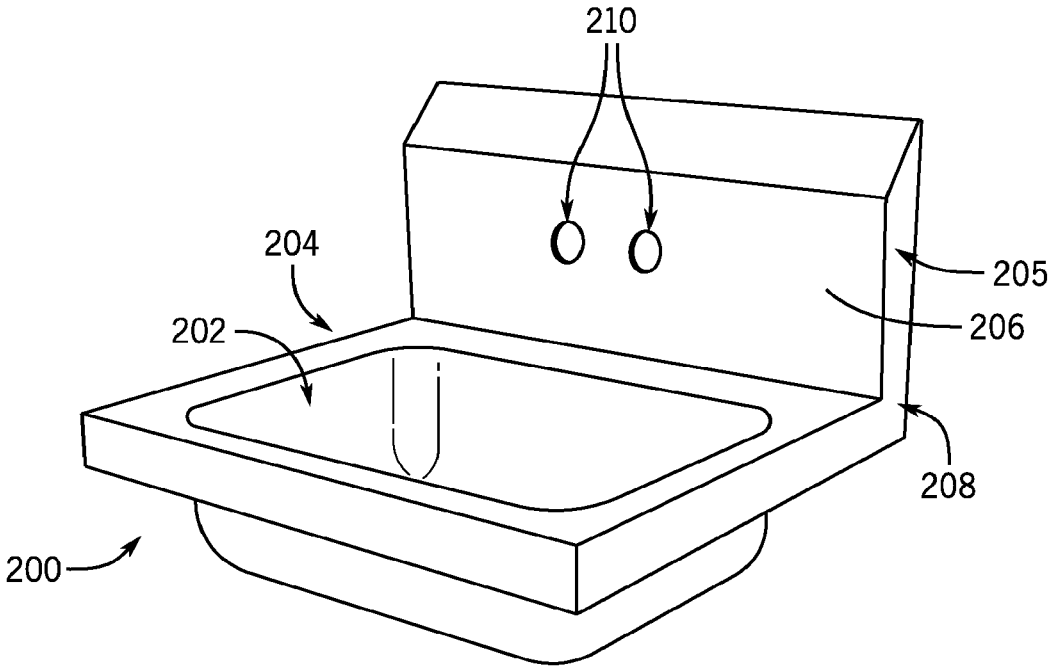
FIG. 2 PRIOR ART
FIG. 2 is a perspective view of an example Prior Art backsplash mount sink basin arrangement.
Figure 11:
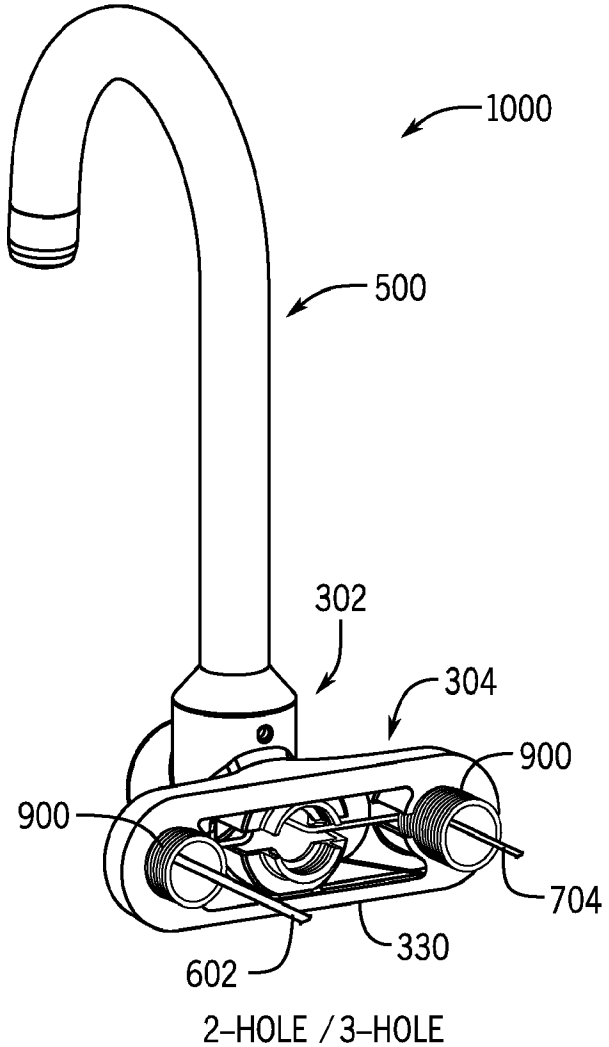
FIG. 11 is a rear perspective view of the first implementation of the improved faucet apparatus of FIG. 10.
Figure 10:
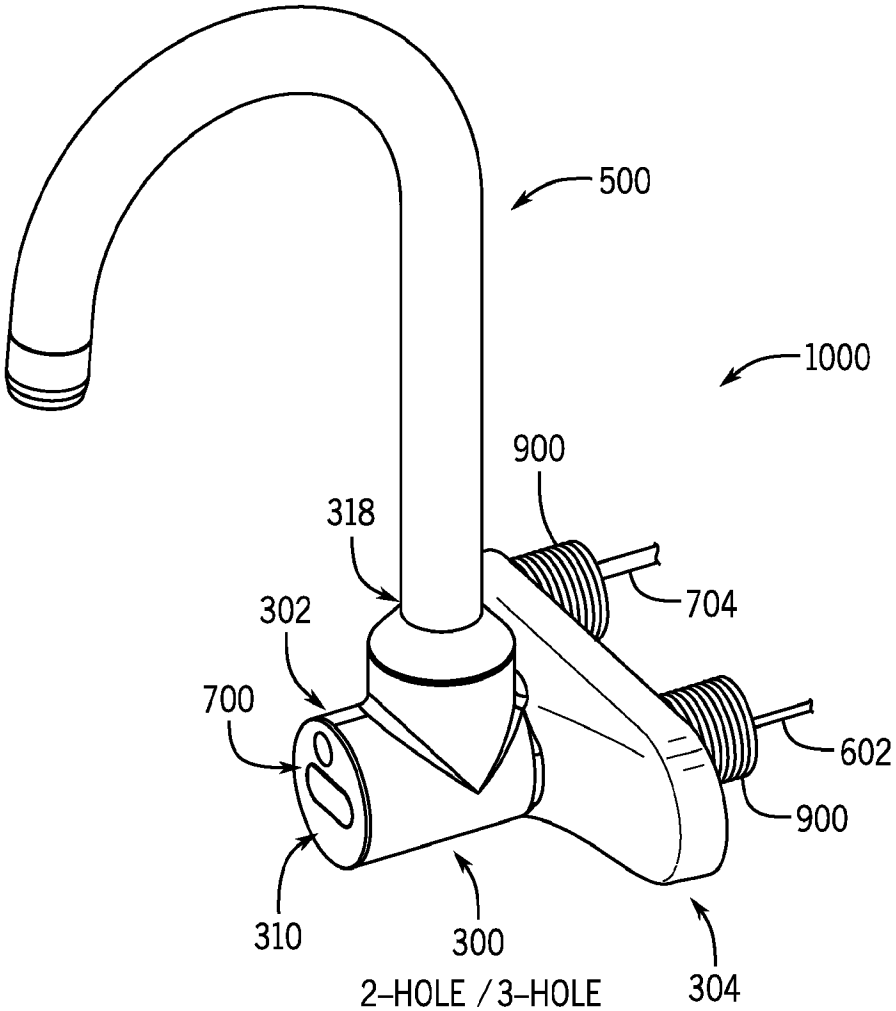
FIG. 10 is a front perspective view of a first implementation of the improved faucet apparatus, of which portions are shown in FIG. 3, FIG. 4, FIG. 5, FIG. 6, FIG. 7, and FIG. 9, in which the improved faucet apparatus is configured to be mounted on a backsplash mount sink basin arrangement having a two-hole arrangement such as that shown in FIG. 2.

Referring particularly to FIGS. 10 and 11, front and rear perspective views are provided of the first implementation 1000 of the faucet, which is an implementation suitable for a backsplash mount sink basin arrangement such as that of FIG. 2. It should be appreciated from FIGS. 10 and 11 that, in the first implementation 1000, the second end 506 (see FIG. 5) of the spout portion 500 is placed in the second orifice 318, which as discussed above is perpendicular relative to the mounting surface 330, and additionally the sensor structure 700 is placed in the first orifice 310, which as discussed above is opposite the mounting surface 330. Additionally, as will be described in more detail below with respect to FIG. 12 and FIG. 13, the first implementation 1000 of the faucet includes two of the threaded sleeves 900, which are attached to the faucet base 304 and particularly partly inserted within the second hole 338 and third hole 340 (see FIG. 3), so as to allow for the faucet to be mounted in regard to a two-hole backsplash mounting sink basin arrangement such as that shown in FIG. 2.

Figure 12:
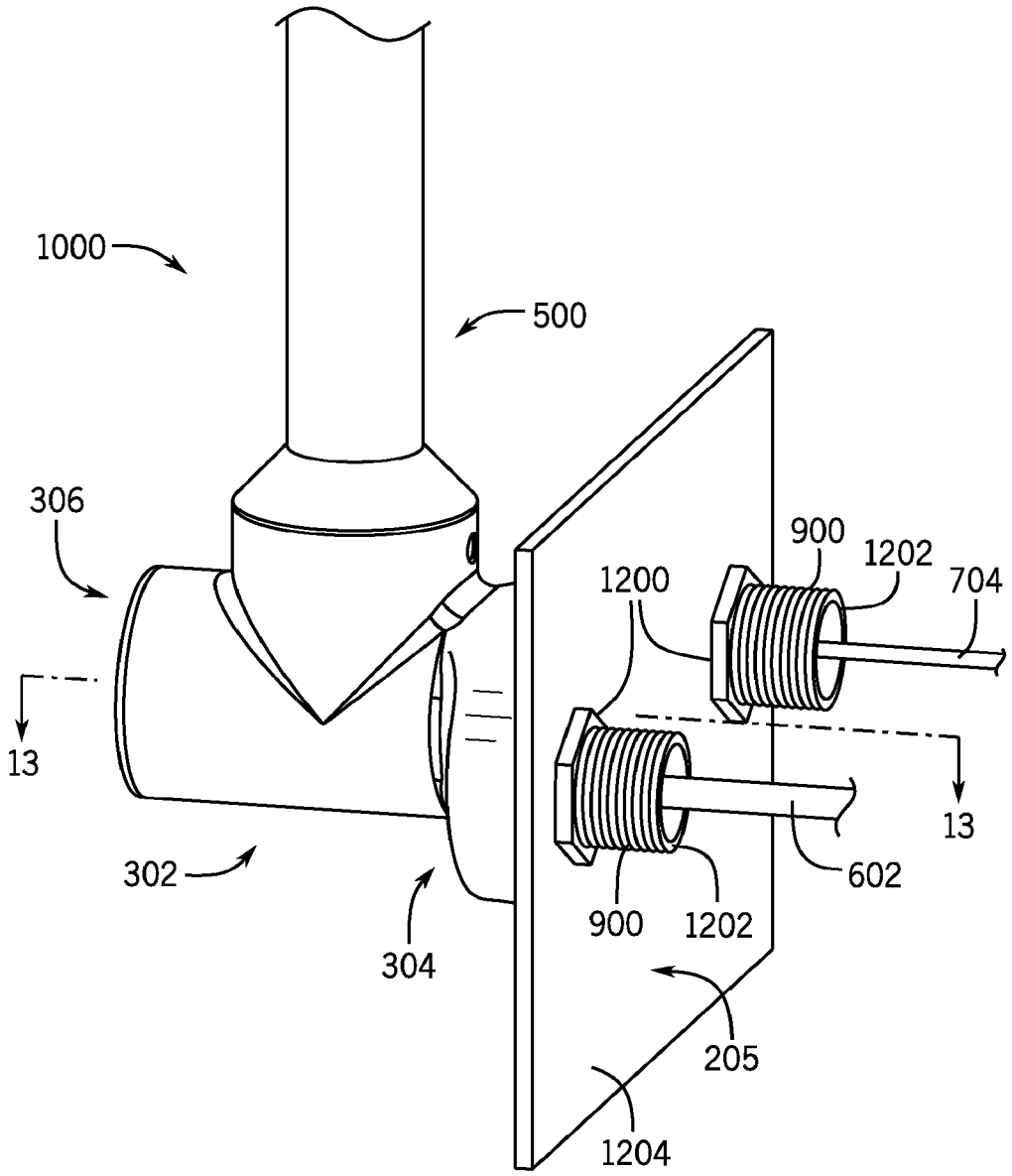
FIG. 12 is a cutaway right side perspective view of the first implementation of the improved faucet apparatus of FIG. 10 and FIG. 11, shown to be further implemented upon a vertical sink wall of a backsplash mount sink basin arrangement by way of a pair of mounting nuts.
Figure 13:
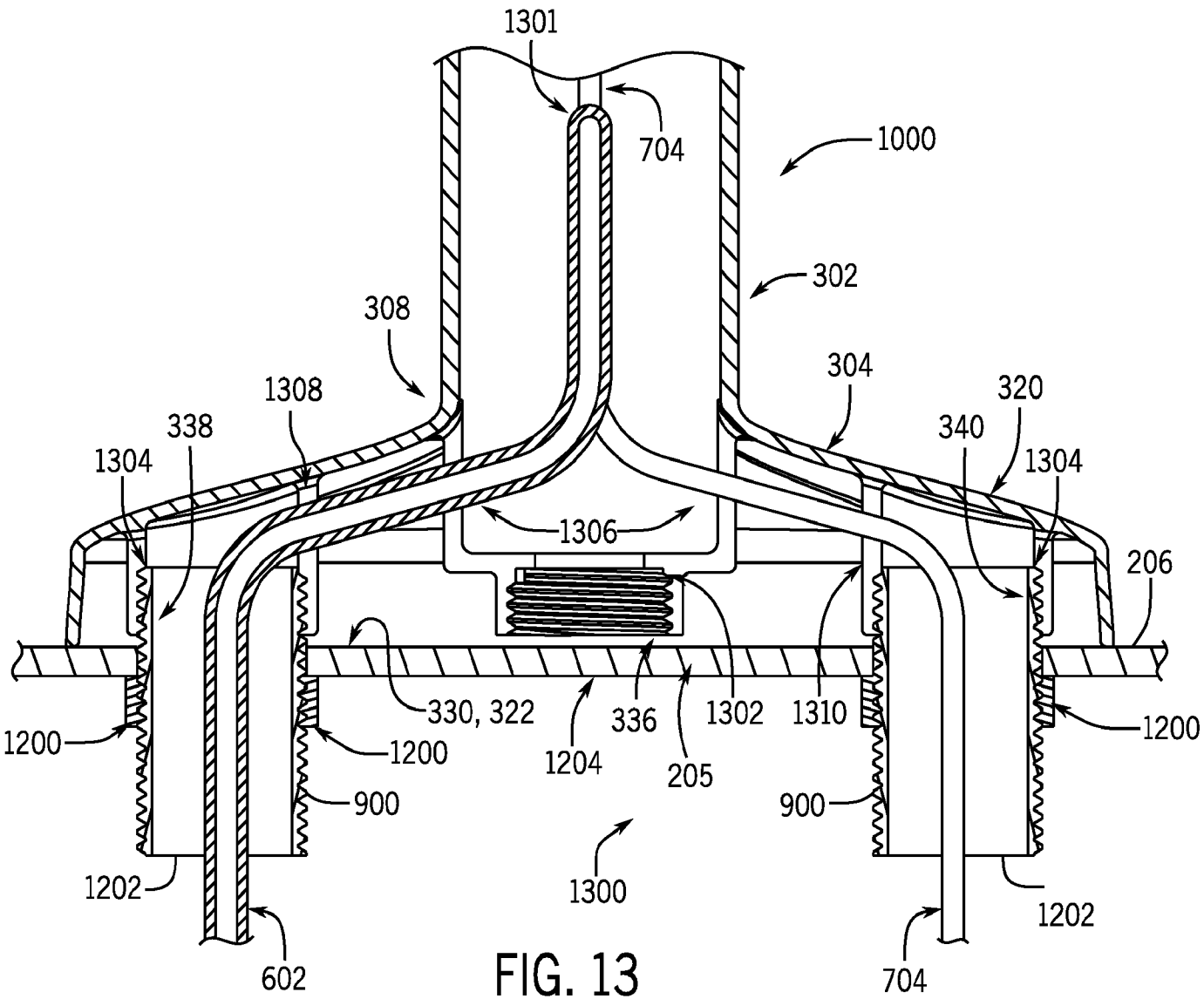
FIG. 13 is a cross-sectional view of the first implementation of the improved faucet apparatus and vertical sink wall of FIG. 12, taken along a line 13-13 of FIG. 12.

Additionally with reference to FIGS. 12 and 13, two additional views are provided to illustrate how the first implementation 1000 of the faucet can be mounted on the vertical sink wall 205 of the backsplash mount sink basin arrangement 200 of FIG. 2. More particularly, FIG. 12 provides a cutaway right side perspective view of the first implementation 1000 when mounted upon the vertical sink wall 205, and FIG. 13 provides a cross-sectional view of the first implementation 1000 and vertical sink wall 205, taken along a line 13-13 of FIG. 12. As shown in FIGS. 12 and 13, mounting and attachment of the first implementation 1000 relative to the vertical sink wall 205 particularly is accomplished by way of the insertion of the threaded sleeves 900, which are attached to the faucet base 304, through complementary ones of the holes 210 within the vertical sink wall 205 (which has two such holes as shown in FIG. 2).

More particularly, when the threaded sleeves 900 are positioned sufficiently far through the holes 210, the mounting surface 330 of the faucet base 304 is in contact with the vertical sink wall surface 206. At this juncture, the faucet can be fixedly attached to the vertical sink wall 205 by rotating complementary mounting nuts 1200 onto the threaded sleeves 900, from their respective outermost ends 1202 extending from the faucet base 304 toward the faucet base until the mounting nuts are in contact with a back surface 1204 of the vertical sink wall 205 that is opposite the vertical sink wall surface 206. As already discussed, in the present embodiment the first implementation 1000 employs two of the threaded sleeves 900 and thus two of the mounting nuts 1200 are respectively implemented onto the respective sleeves in this manner. The mounting nuts 1200 can also be considered to be portions of the faucet (or the first implementation 1000) itself, albeit the mounting nuts can alternatively be considered to be additional components that are distinct from the faucet but nevertheless employed for mounting and attachment of the faucet to the backsplash mount sink basin arrangement 200.

The cross-sectional view of FIG. 13 illustrates additional aspects of the first implementation 1000 and how it is mounted in relation to the vertical sink wall 205. As shown, the two threaded sleeves 900 employed in the first implementation 1000 extend partly into the second and third holes 338 and 340 of the faucet base 304, respectively, and further extend respectively through the two holes 210 within the vertical sink wall 205. As in FIG. 12, the two mounting nuts 1200 are shown to have been fully rotated into position relative to the threaded sleeves 900 and vertical sink wall 205 so as to be in contact with the back surface 1204, such that the faucet is fixedly attached to the vertical sink wall. Additionally, FIG. 13 also reveals in more detail the presence of the flow tube 602 described earlier in regard to FIG. 6 as well as the electrical cable 704 described earlier in regard to FIG. 7 in relation to the first implementation 1000 and vertical sink wall 205.

More particularly as shown, the flow tube 602 extends inward into the faucet base 304 via that one of the threaded sleeves 900 that is positioned within the second hole 338, from a region 1300 exterior of (in this example, behind) the faucet implementation 1000 and the vertical sink wall 205. Additionally as shown, the flow tube 602 further extends, from the faucet base 304, into the faucet body 302 up to a location 1301 that is aligned or substantially aligned with the central axis of the spout portion 500 at the second end 506 thereof, such that the flow tube can continue into and through the spout portion 500 as described in relation to FIG. 6. Also as shown, the electrical cable 704 extends inward into the faucet base 304 via that one of the threaded sleeves 900 that is positioned within the third hole 340, from the region 1300 exterior of the faucet implementation 1000 and the vertical sink wall 205. Additionally as shown, the electric cable 704 further extends, from the faucet base 304, into the faucet body 302 away from the second end 308 and toward the first end 306 (see FIG. 12), for connection to the male cylindrical feature 702 (see FIG. 7).

In the first implementation 1000, in which the faucet is mounted in regard to the two-hole backsplash mounting sink basin arrangement 200, the faucet base 304 is particularly configured internally so as to facilitate the passage of the flow tube 602 and electrical cable 704 from the threaded sleeves 900 to the faucet body 302 illustrated in FIG. 13. As already discussed above, in the present embodiment the faucet base 304 includes the first, second, and third holes 336, 338, and 340, respectively, each of which is threaded so as to allow for insertion and attachment of respective one(s) of the threaded sleeve(s) 900 in relation to any one or more of the holes. Further, in the present embodiment, the first, second, and third holes 336, 338, and 340 are threaded sufficiently far into the faucet base 304 as to allow for the threaded sleeve(s) 900 to be partly, but not fully, inserted into the holes. The depth of the threading ends just before cutouts that are formed in the faucet base, and leaves space within the faucet base 304 for the flow tube 602 and electrical cable 704 to proceed to the faucet body 302.

More particularly as shown in FIG. 13, the first hole 336 is shown to be threaded, away from the second side 322 and mounting surface 330 and toward the first side 320, up to a first position (or distance) 1302 away from the second side 322. Also, each of the second and third holes 338 and 340 is shown to be threaded, away from the second side 322 and mounting surface 330 and toward the first side 320, up to a second position (or distance) 1304 away from the second side. Further, the faucet base 304 includes first cutouts 1306 along the first (e.g., center) hole 336 between the first position 1302 and the first side 320, and the first cutouts are cut out on each side of that hole along the centerline of the hole so as to be present on opposite sides of the hole. Additionally, the faucet base 304 also includes a second cutout 1308 along the second hole 338 between the second position 1304 and the first side, and a third cutout 1310 along the third hole 340 between the second position 1304 and the first side. Thus, each of the second and third holes 338 and 340, which are the outside holes, has a respective cutout on the respective side of the respective hole that faces the first (center) hole 336. The second cutout 1308, and that one of the first cutouts 1306 that is closer to the second cutout, permit the flow tube 602 to be run, within the faucet base 304, from the threaded sleeve 900 positioned within the second hole 338 to the faucet body 302. The third cutout 1310, and that one of the first cutouts 1306 that is closer to the third cutout, permit the electrical cable 704 to be run, within the faucet base 304, from the threaded sleeve 900 positioned within the third hole 340 to the faucet body 302.

Therefore, by virtue of the features of the faucet base 304, the threaded sleeves 900 when inserted into the second and third holes 338 and 340 will bottom out against the depth of the faucet base threads as shown in FIG. 13, thus creating a channel for tube(s) and cable(s) such as the flow tube 602 and electrical cable 704 to be routed from the faucet body 302 through the faucet base 304 and into the threaded sleeves and allowing them to pass beyond the mounting surface 330 and through the vertical sink wall 205 to connections in the region 1300 or elsewhere (e.g., below the sink).

Figure 15:
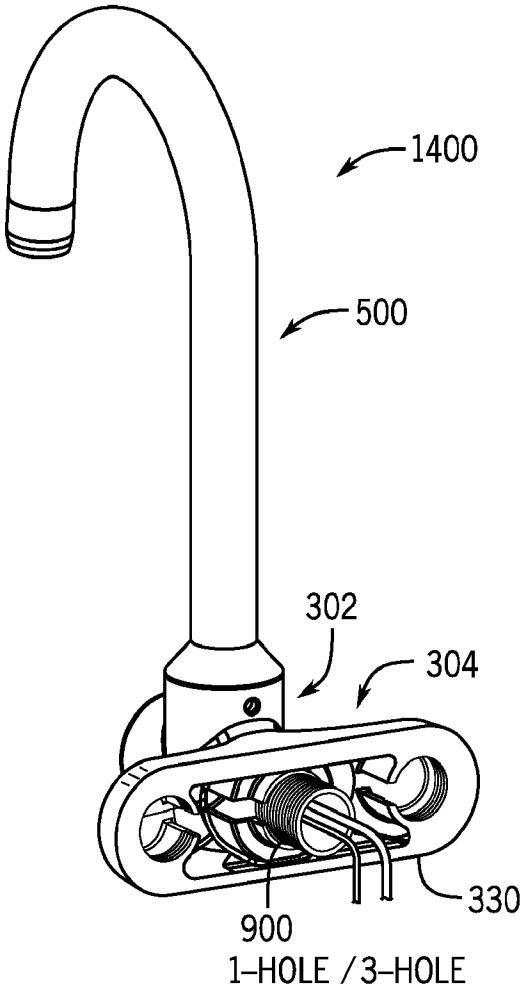
FIG. 15 is a rear perspective view of the second implementation of the improved faucet apparatus of FIG. 14.
Figure 14:
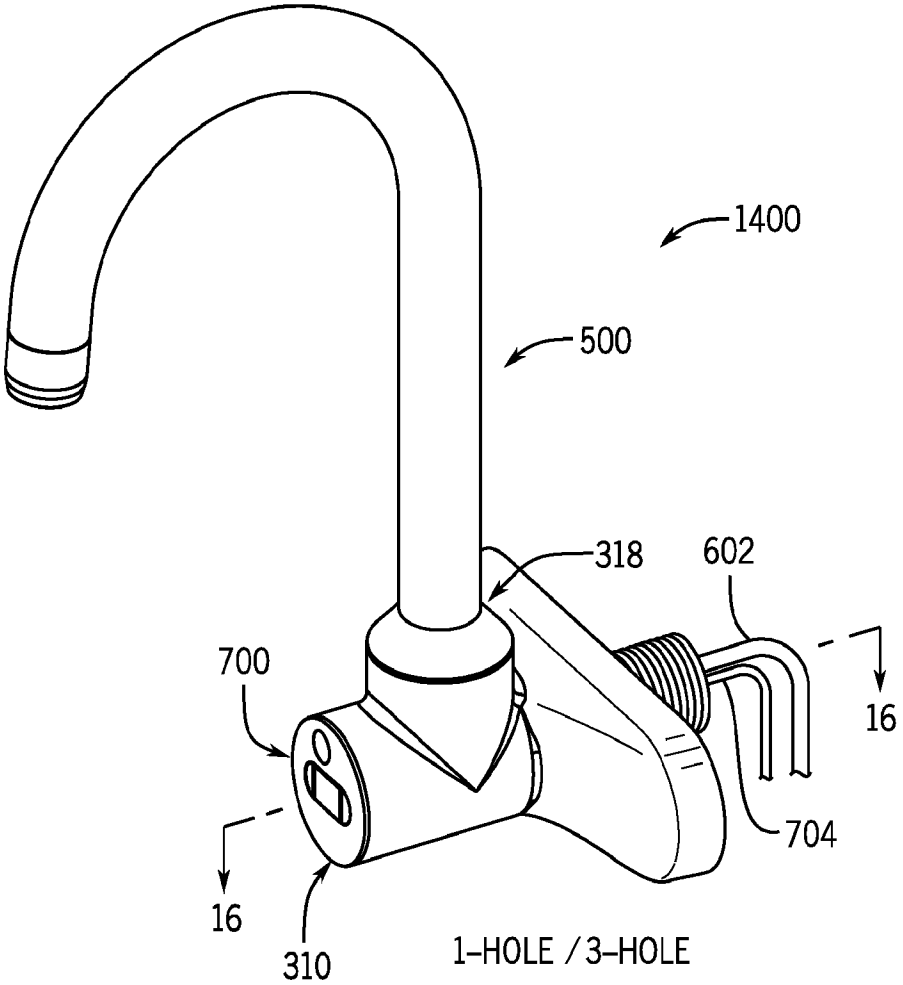
FIG. 14 is a front perspective view of a second implementation of the improved faucet apparatus, of which portions are shown in FIG. 3, FIG. 4, FIG. 5, FIG. 6, FIG. 7, and FIG. 9, in which the improved faucet apparatus is configured to be mounted on a backsplash mount sink basin arrangement having a single-hole (or one-hole) arrangement.

Turning to FIGS. 14 and 15, front and rear perspective views are provided of the second implementation 1400 of the faucet, which also is an implementation suitable for a backsplash mount sink basin arrangement. As with the first implementation 1000, the second end 506 (see FIG. 5) of the spout portion 500 is placed in second orifice 318, and additionally the sensor structure 700 is placed in the first orifice 310, which as discussed above is opposite the mounting surface 330. However, in contrast with the first implementation 1000, the second implementation 1400 is configured to allow for the faucet to be mounted in regard to a single-hole backsplash mounting sink basin arrangement. Consequently, the second implementation 1400 of the faucet includes only a single one of the threaded sleeves 900, which is attached to the faucet base 304 and particularly partly inserted within the first hole 336 (see FIG. 3).

Figure 16:
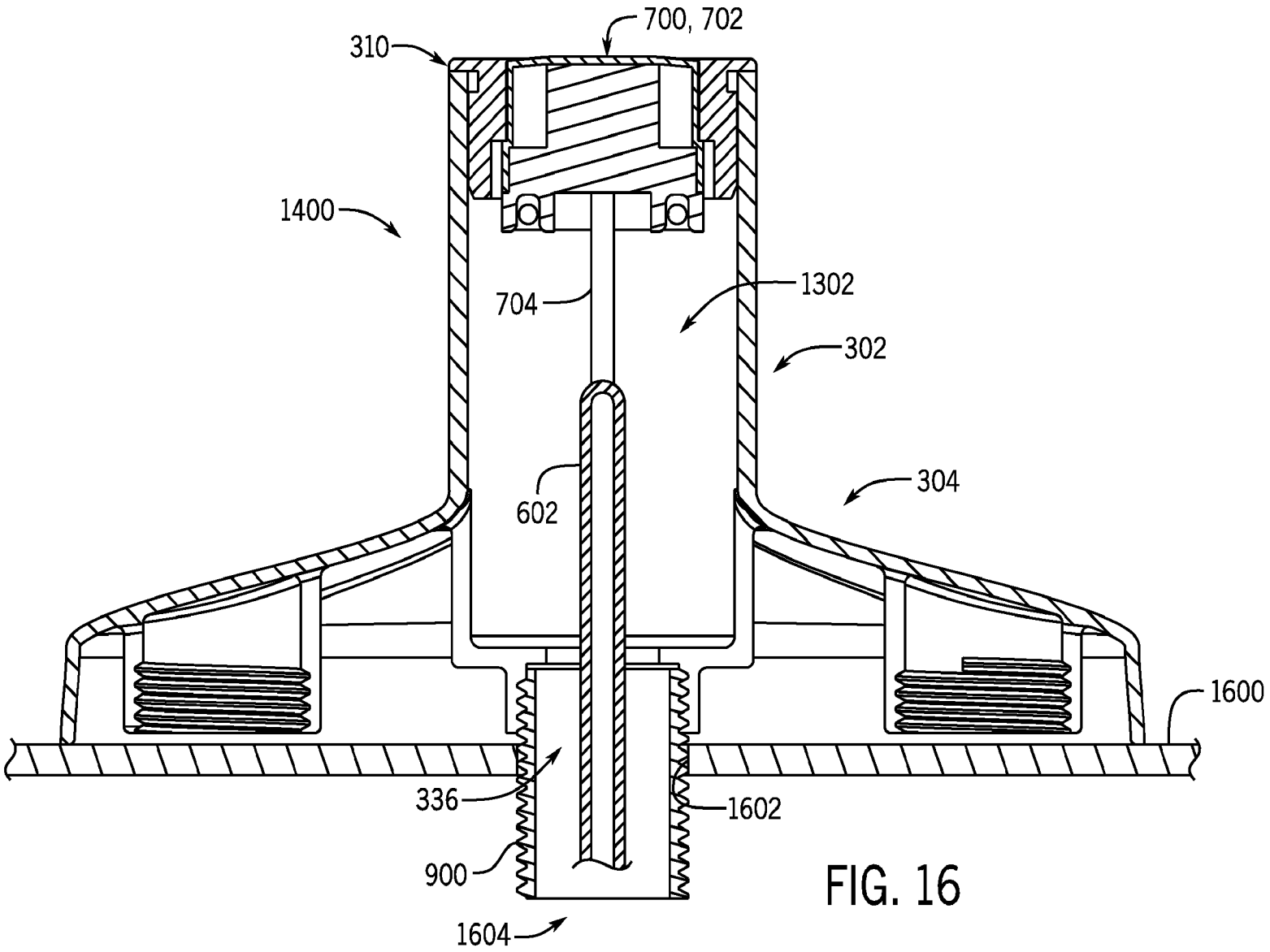
FIG. 16 is a cross-sectional view of the second implementation of the improved faucet apparatus of FIG. 14 and FIG. 15, taken along a line 16-16 of FIG. 14, and further shown to be implemented upon a vertical sink wall of a backsplash mount sink basin arrangement (shown in cutaway)

Referring additionally to FIG. 16, an additional view is provided to illustrate how the second implementation 1400 of the faucet can be mounted on a vertical sink wall 1600 of a backsplash mounting sink basin arrangement having a single mounting hole rather than two holes (as was the case with the backsplash mount sink basin arrangement 200 and vertical sink wall 205 thereof). More particularly, FIG. 16 provides a cross-sectional view of the second implementation 1400 and vertical sink wall 1600, taken along a line 16-16 of FIG. 14 (and that corresponds in position to the line 13-13 of FIG. 12 with respect to the first implementation 1000). As shown in FIG. 16, mounting and attachment of the second implementation 1400 relative to the vertical sink wall 1600 is accomplished by way of the insertion of the single one of threaded sleeves 900, which is attached to the faucet base 304 by way of the first hole 336, through a complementary single hole 1602 extending through the vertical sink wall 1600.

In the second implementation 1400, when installed in regard to a single-hole sink basin arrangement, both the flow tube 602 and the electrical cable 704 are passed directly through the single threaded sleeve 900 that is positioned within the first hole 336 that is the center hole among the first, second, and third holes 336, 338, and 340. That is, both of the flow tube 602 and the electrical cable 704 extend from a region 1604 exterior of the faucet and behind the vertical sink wall 1600 (and possibly beneath the sink basin arrangement), through the single threaded sleeve 900 and the vertical sink wall 1600 through which that threaded sleeve 900 extends, into the faucet base 304, and up to the location 1301 (the same location as discussed in regard to FIG. 13) aligned with the central axis of the spout portion 500. As in the case of the first implementation 1000, in the second implementation 1400 the flow tube 602 proceeds from the location 1301 into and through the length of the spout portion 500, and the electrical cable 704 proceeds from the location 1301 to the male cylindrical feature 702 at the first end 306 of the faucet body 302. Although shown as being aligned in FIG. 16, it is not critical that the flow tube 602 and the electrical cable 704 be exactly aligned with one another and, if not aligned, the electrical cable 704 would be more fully visible (rather than obstructed by the flow tube 602 as shown in FIG. 16).

It should be appreciated that the first and second implementations 1000 and 1400 of the faucet shown in FIGS. 10-16 are not the only possible implementations of the faucet in relation to backsplash mount sink basin arrangements. Among other things, in other implementations for two-hole backsplash mount sink basin arrangements, the relative positioning of the flow tube 602 and electrical cable 704 can be reversed from that shown in FIGS. 10-13 such that the flow tube passes through the third hole 340 and the electrical cable passes through the second hole 338. Also, alternatively, in some additional implementations for two-hole backsplash mount sink basin arrangements, both the flow tube 602 and the electrical cable 704 can be positioned so as to pass through only a single one of the threaded sleeves 900, through one or the other (but not both) of the second and third holes 338 and 340.

Additionally, in further implementations, the faucet is configured for mounting in relation to a three-hole backsplash mount sink basin arrangement. In such implementations, the flow tube 602 and electrical cable 704 can respectively be routed through any one or two of the three different ones of the threaded sleeves 900 that are inserted in each of the first, second, and third holes 336, 338, and 340, in whatever manner that is most convenient. Also, the present disclosure is intended to encompass implementations in which there are additional tube(s) and/or cable(s) in addition to the flow tube 602 and electrical cable 704.

Figure 18:
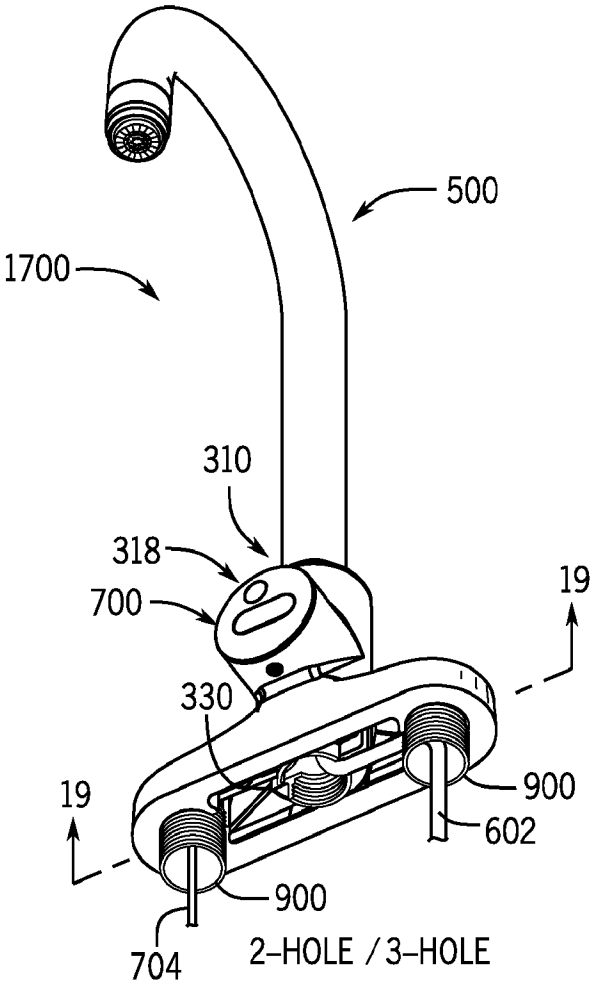
FIG. 18 is a bottom perspective view of the third implementation of the improved faucet apparatus of FIG. 17.
Figure 17:
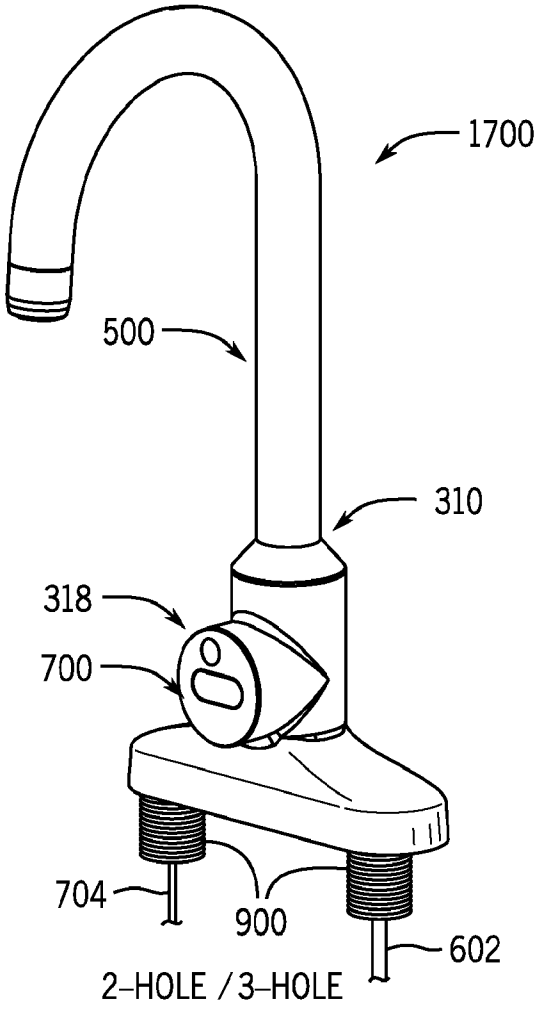
FIG. 17 is a front perspective view of a third implementation of the improved faucet apparatus, of which portions are shown in FIG. 3, FIG. 4, FIG. 5, FIG. 6, FIG. 7, and FIG. 9, in which the improved faucet apparatus is configured to be mounted on a deck mount sink basin arrangement having a two-hole arrangement.

Referring next to FIGS. 17 and 18, front and bottom perspective views are provided of the third implementation 1700 of the faucet, which is an implementation suitable for a deck mount sink basin arrangement that, although similar to that shown in FIG. 1, has two holes rather than three holes as shown in FIG. 1. It should be appreciated from FIGS. 17 and 18 that, in the third implementation 1700, the sensor structure 700 is placed in the second orifice 318, which as discussed above is perpendicular to the mounting surface 330, and additionally the second end 506 (see FIG. 5) of the spout portion 500 is placed in the first orifice 310, which as discussed above is opposite the mounting surface 330. Further, to permit attachment in relation to a two-hole deck mount sink basin arrangement, the third implementation 1700 of the faucet includes two of the threaded sleeves 900, which are attached to the faucet base 304 and particularly partly inserted within the second hole 338 and third hole 340 (see FIG. 3).

Figure 19:
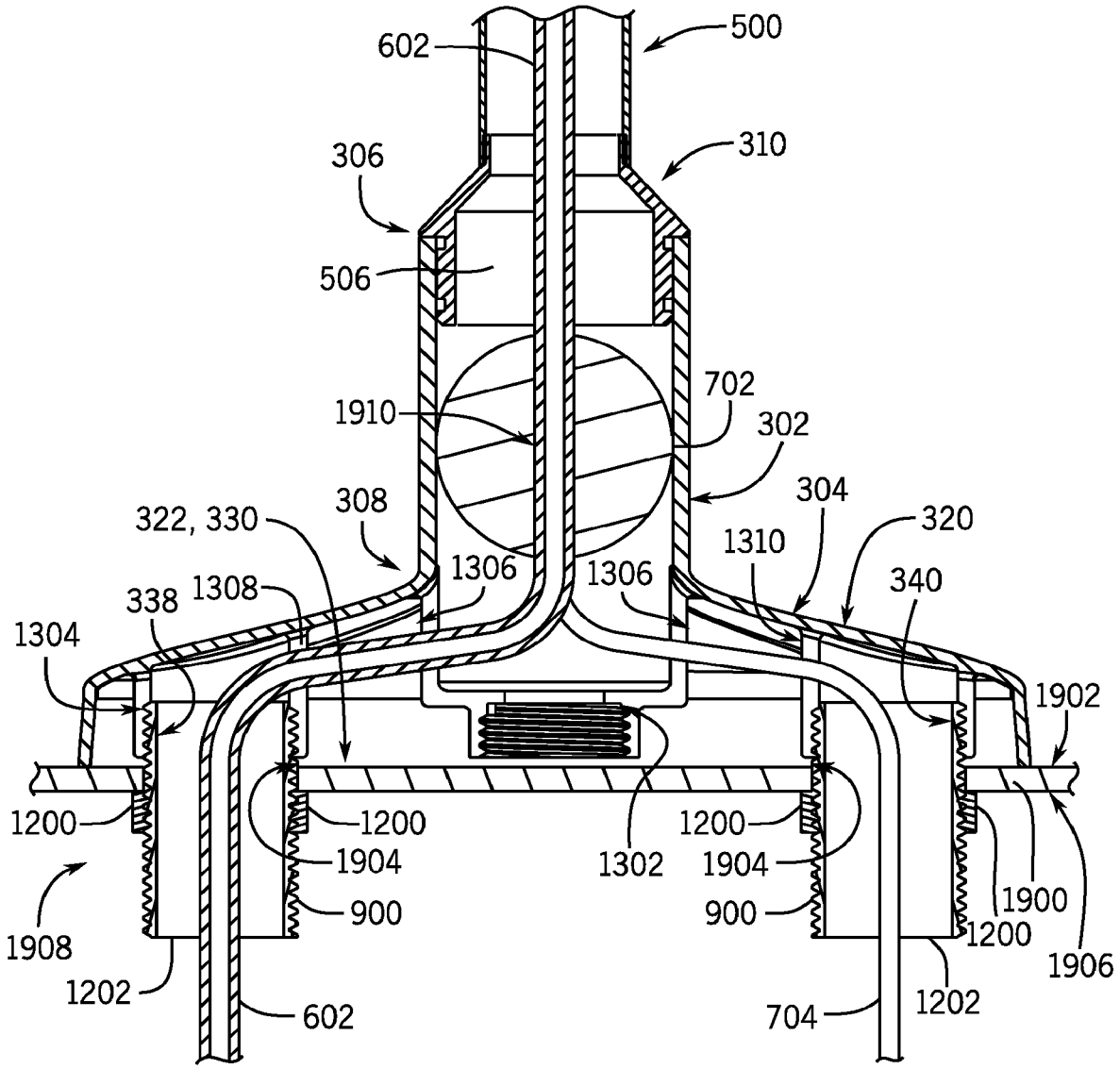
FIG. 19 is a cross-sectional view of the third implementation of the improved faucet apparatus of FIG. 17 and FIG. 18, taken along a line 19-19 of FIG. 18, and further shown to be implemented upon a horizontal rim wall of a deck mount sink basin arrangement (shown in cutaway)

Additionally with reference to the third implementation 1700 of FIGS. 17 and 18, FIG. 19 provides an additional view in which the third implementation of the faucet is shown to be mounted on a horizontal surface 1902 of a horizontal rim wall 1900 of a deck mount sink basin arrangement. In this example, the horizontal surface 1902 and horizontal rim wall 1900 respectively are identical to the horizontal surface 104 and horizontal rim wall 103 shown in FIG. 1 except insofar as only two (rather than three) holes 1904 are formed in the surface 1902 and wall 1900 (with the spacing between those holes being identical or substantially similar to that of the holes 210 of FIG. 2). Further, it should be appreciated that the view provided in FIG. 19 is a cutaway cross-sectional view of the third implementation 1700 and horizontal rim wall 1900 if taken along a line 19-19 of FIG. 18 after the third implementation 1700 has been mounted upon that horizontal rim wall (that is, the horizontal rim wall is not shown in FIG. 18). FIG. 19 illustrates that mounting and attachment of the third implementation 1700 relative to the horizontal rim wall 1900 particularly is accomplished by way of the insertion of two of the threaded sleeves 900, which are attached to the faucet base 304, through the two complementary holes 1904 within the horizontal rim wall 1900.

More particularly, when the threaded sleeves 900 are positioned sufficiently far through the holes 1904, the mounting surface 330 of the faucet base 304 is in contact with the horizontal surface 1902. At this juncture, the faucet can be fixedly attached to the horizontal rim wall 1900 by rotating complementary mounting nuts 1200 onto the threaded sleeves 900, from their respective outermost ends 1202 extending from the faucet base 304, toward the faucet base until the mounting nuts are in contact with an underside 1906 of the horizontal rim wall that is opposite the horizontal surface 1902. The third implementation 1700 employs two of the threaded sleeves 900 and thus two of the mounting nuts 1200 are respectively implemented onto the respective sleeves in this manner. As discussed previously, the mounting nuts 1200 can also be considered to be portions of the faucet (or the third implementation 1700) itself, albeit the mounting nuts can alternatively be considered to be additional components that are distinct from the faucet but nevertheless employed for mounting and attachment of the faucet to the deck mount sink basin arrangement.

The cross-sectional view of FIG. 19 illustrates additional aspects of the third implementation 1700 and how it is mounted in relation to the horizontal rim wall 1900. As shown, the two threaded sleeves 900 employed in the third implementation 1700 extend partly into the second and third holes 338 and 340 of the faucet base 304, respectively, and further extend respectively through the two holes 1904 within the horizontal rim wall 1900. Further, the two mounting nuts 1200 are shown to have been fully rotated into position relative to the threaded sleeves 900 and horizontal rim wall 1900 so as to be in contact with the underside 1906, such that the faucet is fixedly attached to the horizontal rim wall.

Similarly to FIG. 13, FIG. 19 also reveals the presence of the flow tube 602 and the electrical cable 704 in relation to the third implementation 1700 and horizontal rim wall 1900. As shown, the flow tube 602 extends inward into the faucet base 304 via that one of the threaded sleeves 900 that is positioned within the second hole 338, from a region 1908 exterior of (in this example, beneath) the faucet implementation 1700 and the horizontal rim wall 1900. The flow tube 602 further extends, from the faucet base 304, into the faucet body 302 up to and into the spout portion 500, such that the tube can continue into and through the spout portion as described in relation to FIG. 6. Additionally as shown, the electrical cable 704 extends inward into the faucet base 304 via that one of the threaded sleeves 900 that is positioned within the third hole 340, from the region 1908. The electrical cable 704 further extends, from the faucet base 304, into the faucet body 302 away from the second end 308, for connection to the male cylindrical feature 702. In the particular cross-sectional view provided by FIG. 19, it should be recognized that the electrical cable 704 is obstructed from view by the presence of the flow tube 602 as those structures pass through the faucet body 302, due to those structures being axially aligned (although in alternate embodiments, such alignment is not necessary).

Figure 20:
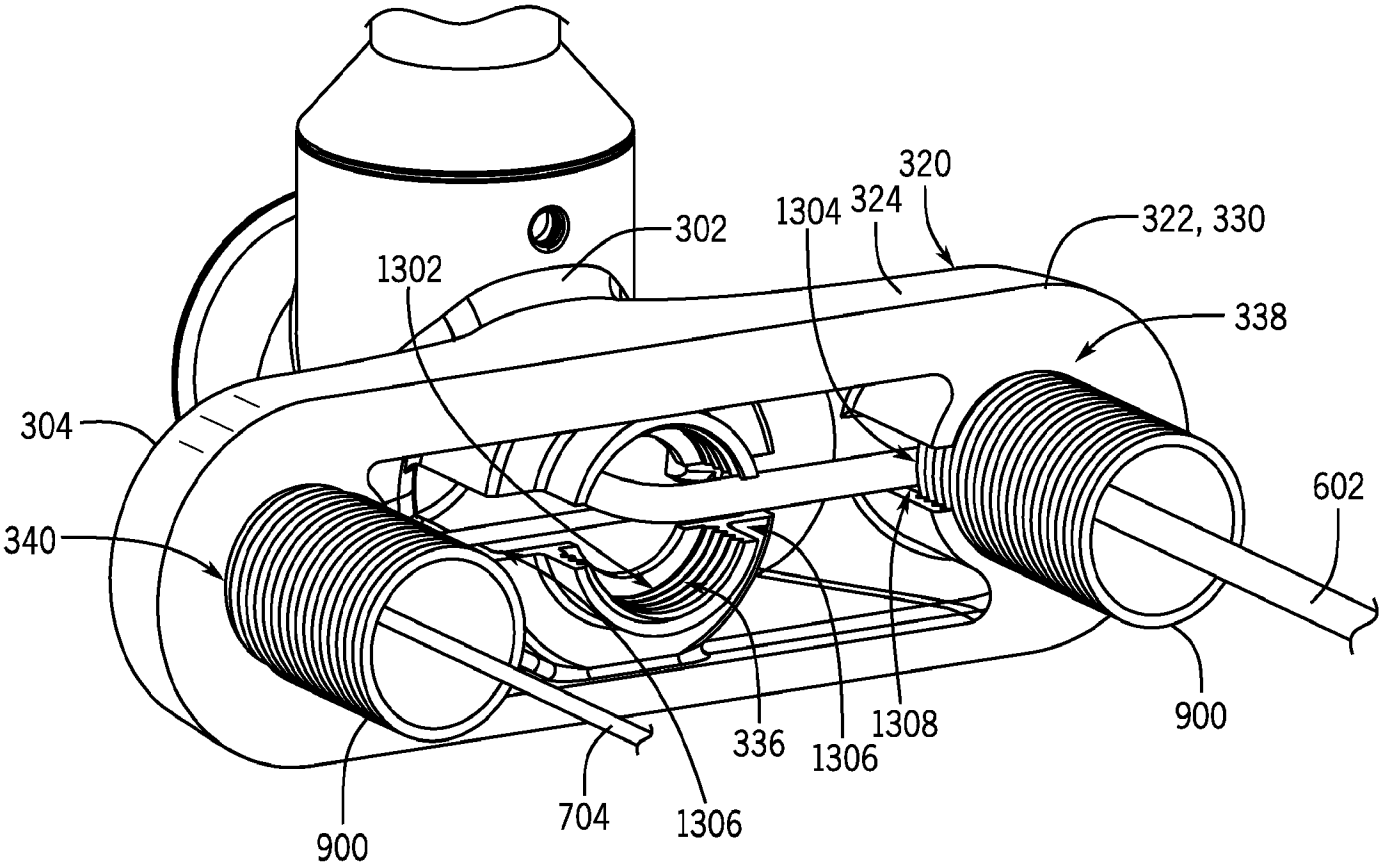
FIG. 20 is an additional, cutaway bottom perspective view of the third implementation of the improved faucet apparatus of FIG. 17, which reveals in more detail structural aspects within an interior of the improved faucet apparatus.

As discussed already in regard to FIG. 13, the faucet base 304 is configured internally so as to facilitate the passage of the flow tube 602 and electric cable 704 from the threaded sleeves 900 to the faucet body 302 when the flow tube 602 and/or electrical cable 704 are routed into the faucet base 304 via the threaded sleeve(s) 900 positioned within one or both of the second and third holes 338 and 340. FIG. 20 is additionally provided to show the third implementation 1700, but not the horizontal rim wall 1900, in greater detail and to highlight the internal configuration of the faucet base 304 in this regard. More particularly, FIG. 20 shows that each of the first, second, and third holes 336, 338, and 340, respectively, are threaded so as to allow for insertion and attachment of the threaded sleeve(s) 900 with respect to any one or more of the holes. Further as shown, the first, second, and third holes 336, 338, and 340 are threaded sufficiently far into the faucet base 304 so as to allow for the threaded sleeve(s) 900 to be partly, but not fully, inserted into the holes. The depth of the threading ends just before the cutouts that are formed in the faucet base, and leaves space within the faucet base 304 for the flow tube 602 and electrical cable 704 to proceed to the faucet body 302.

More particularly, FIGS. 19 and 20 show the first cutouts 1306 along the first (e.g., center) hole 336 between the first position 1302 and the first side 320, on opposite sides of that hole, as well as the second cutout 1308 along the second hole 338 between the second position 1304 and the first side 320. Although not visible from the perspective view of FIG. 20, it should be appreciated from FIG. 19 that, again, the third cutout 1310 along the third hole 340 is also present in the faucet base 304 in the third implementation 1700. The second cutout 1308, and that one of the first cutouts 1306 that is closer to the second cutout, thus permit the flow tube 602 to be run, within the faucet base 304, from the threaded sleeve 900 positioned within the second hole 338 to the faucet body 302. Also, the third cutout 1310, and that one of the first cutouts 1306 that is closer to the third cutout, permit the electrical cable 704 to be run, within the faucet base 304, from the threaded sleeve 900 positioned within the third hole 340 to the faucet body 302. Additionally in this arrangement, the flow tube 602 extends within the faucet body 302 all of the way to the first orifice 310, at which it enters and proceeds through the spout portion 500, and the electrical cable 704 in contrast merely proceeds up to a location 1910, at which it turns and proceeds to the male cylindrical feature 702 within the second orifice 318.

Again therefore (as with the first implementation 1000 as shown in FIG. 13), by virtue of the features of the faucet base 304, the threaded sleeves 900 when inserted into the second and third holes 338 and 340 will bottom out against the depth of the faucet base threads as shown in FIGS. 19 and 20, thus creating a channel for tube(s) and cable(s) such as the flow tube 602 and electrical cable 704 to be routed from the faucet body 302 through the faucet base 304 and into the threaded sleeves and allowing them to pass beyond the mounting surface 330 and through the horizontal rim wall 1900 to connections in the region 1908 or elsewhere.

Figure 22:
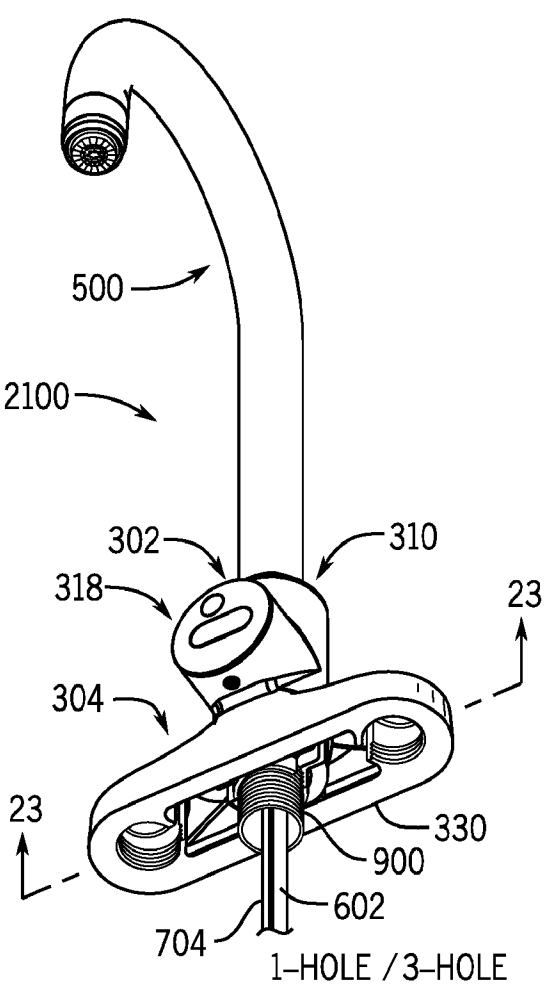
FIG. 22 is a bottom perspective view of the fourth implementation of the improved faucet apparatus of FIG. 21.
Figure 21:
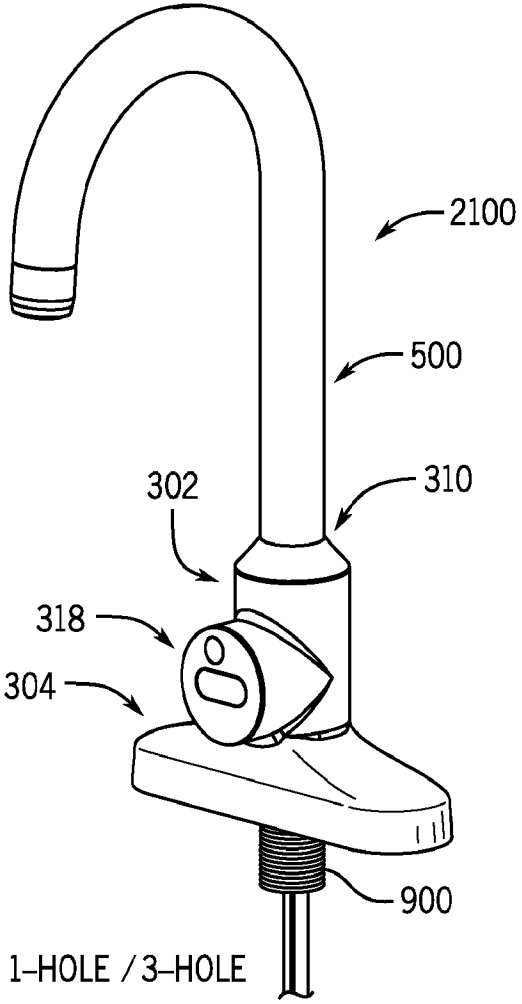
FIG. 21 is a front perspective view of a fourth implementation of the improved faucet apparatus, of which portions are shown in FIG. 3, FIG. 4, FIG. 5, FIG. 6, FIG. 7, and FIG. 9, in which the improved faucet apparatus is configured to be mounted on a deck mount sink basin arrangement having a single-hole (one-hole) arrangement.

Turning to FIGS. 21 and 22, front and bottom perspective views are provided of the fourth implementation 2100 of the faucet, which also is an implementation suitable for a deck mount sink basin arrangement. As with the third implementation 1700, the second end 506 (see FIG. 5) of the spout portion 500 is placed in the first orifice 310, which as discussed above is opposite the mounting surface 330, and additionally the sensor structure 700 is placed in the second orifice 318. However, in contrast with the third implementation 1700, the fourth implementation 2100 is configured to allow for the faucet to be mounted in regard to a single-hole deck mount sink basin arrangement. Consequently, the fourth implementation 2100 of the faucet includes only a single one of the threaded sleeves 900, which is attached to the faucet base 304 and particularly partly inserted within the first hole 336 (see FIG. 3).

Figure 23:
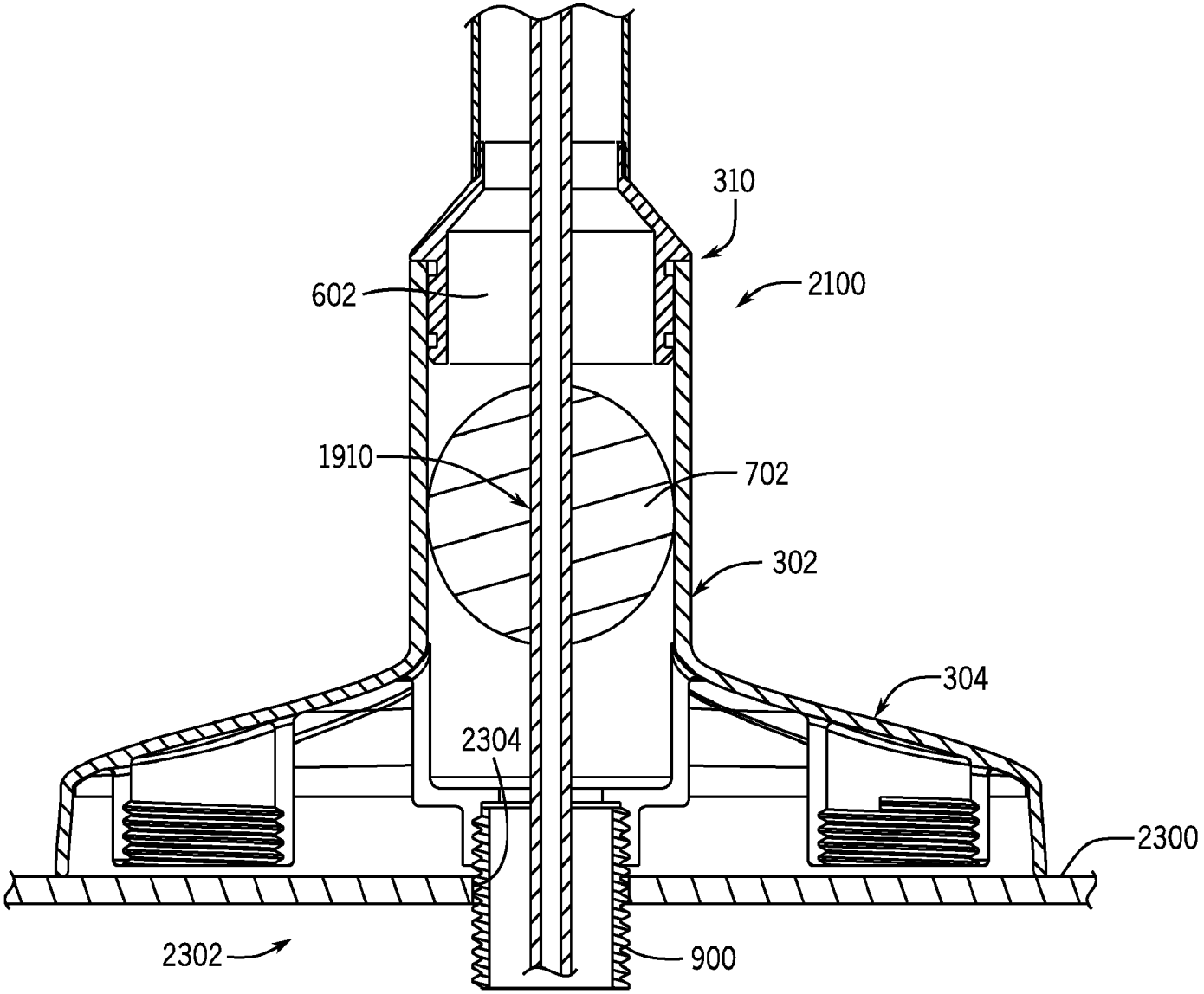
FIG. 23 is a cross-sectional view of the fourth implementation of the improved faucet apparatus of FIG. 21 and FIG. 22, taken along a line 23-23 of FIG. 22.

Referring additionally to FIG. 23, an additional view is provided to illustrate how the fourth implementation 2100 of the faucet can be mounted on a horizontal rim wall 2300 of a deck mount sink basin arrangement having a single mounting hole rather than two holes (as was the case with the horizontal rim wall 1900. More particularly, FIG. 23 provides a cross-sectional view of the fourth implementation 2100 and horizontal rim wall 2300, taken along a line 23-23 of FIG. 22 (and that corresponds in position to the line 19-19 of FIG. 18 with respect to the third implementation 1700). As shown in FIG. 23, mounting and attachment of the fourth implementation 2100 relative to the horizontal rim wall 2300 is accomplished by way of the insertion of the single one of threaded sleeves 900, which is attached to the faucet base 304 by way of the first hole 336, through a complementary single hole 2304 extending through the horizontal rim wall 2300.

In the fourth implementation 2100, when installed in regard to a single-hole sink basin arrangement, both the flow tube 602 and the electrical cable 704 are passed directly through the single threaded sleeve 900 that is positioned within the first hole 336 that is the center hole among the first, second, and third holes 336, 338, and 340. That is, both of the flow tube 602 and the electrical cable 704 extend from a region 2302 exterior of the faucet and beneath the sink basin arrangement, through the single threaded sleeve 900 and through the horizontal rim wall 2300 through which that threaded sleeve 900 extends, into the faucet base 304 and to the faucet body 302. Additionally in this arrangement, the flow tube 602 extends within the faucet body 302 all of the way to the first orifice 310, at which it enters and proceeds through the spout portion 500. The electrical cable 704 in contrast merely proceeds up to the location 1910, at which it turns and proceeds to the male cylindrical feature 702 within the second orifice 318. Although shown as being aligned in FIG. 23, it is not critical that the flow tube 602 and the electrical cable 704 be exactly aligned with one another and, if not aligned, the electrical cable 704 would be more fully visible (rather than obstructed by the flow tube 602 as shown in FIG. 23).

It should be appreciated that the third and fourth implementations 1700 and 2100 of the faucet shown in FIGS. 17-23 are not the only possible implementations of the faucet in relation to deck mount sink basin arrangements. Among other things, in other implementations for two-hole deck mount sink basin arrangements, the relative positioning of the flow tube 602 and electrical cable 704 can be reversed from that shown in FIGS. 17-20 such that the flow tube passes through the third hole 340 and the electrical cable passes through the second hole 338. Also, alternatively, in some additional implementations for two-hole deck mount sink basin arrangements, both the flow tube 602 and the electrical cable 704 can be positioned so as to pass through only a single one of the threaded sleeves 900, through one or the other (but not both) of the second and third holes 338 and 340.

Additionally, in further implementations, the faucet is configured for mounting in relation to a three-hole deck mount sink basin arrangement such as that shown in FIG. 1. In such implementations, the flow tube 602 and electrical cable 704 can respectively be routed through any one or two of the three different ones of the threaded sleeves 900 that are inserted in each of the first, second, and third holes 336, 338, and 340, in whatever manner that is most convenient. Also, the present disclosure is intended to encompass implementations in which there are additional tube(s) and/or cable(s) in addition to the flow tube 602 and electrical cable 704.

It should be appreciated from the above description that the present disclosure is intended also to encompass methods of implementation or assembly of faucets (or faucet implementations) in regard to various types of support structures such as deck mount or backsplash mount sink basin arrangements. In at least some such methods encompassed herein, to mount a faucet to such a sink basin arrangement or other support structure, the method begins with determining the type of sink basin arrangement or other support structure in relation to which the faucet is to be mounted, and the appropriate implementation for such arrangement. Next, the method proceeds with the spout portion 500 and sensor structure portion 700 being installed in the first and second orifices 310 and 318 in a manner that is appropriate for the particular implementation (e.g., with either the spout portion being positioned in the first orifice and the sensor structure being positioned in the second orifice, or vice-versa). Further, the electrical (e.g., sensor) cable 704 and flow (e.g., internal spout) tube 602 are passed through either one or more than one (e.g., two) of the threaded sleeve(s), as appropriate for the sink basin arrangement or other support structure in relation to which the faucet is being implemented.

Next the one or more threaded sleeve(s) 900 are then threaded into one or more of the first, second, and third holes 336, 338, and 340 of the faucet body, as appropriate in view of the number of holes of the sink basin arrangement or other support structures, until the sleeve threads bottom out in the threaded holes. Further, the threaded sleeves can then be inserted into the mounting holes within the sink basin arrangement or other support structure until the mounting surface 330 encounters the support surface of that support structure, at which point one or more of the mounting nuts 1200 (as appropriate to suit the number of threaded sleeves) is or are then tightened onto the threaded sleeve(s) so as to clamp the faucet onto the sink basin arrangement or other support structure. After this assembly is complete, operation of the faucet can proceed, including the controlling and dispensing of water or other fluid/liquid from the faucet.

Figure 24:
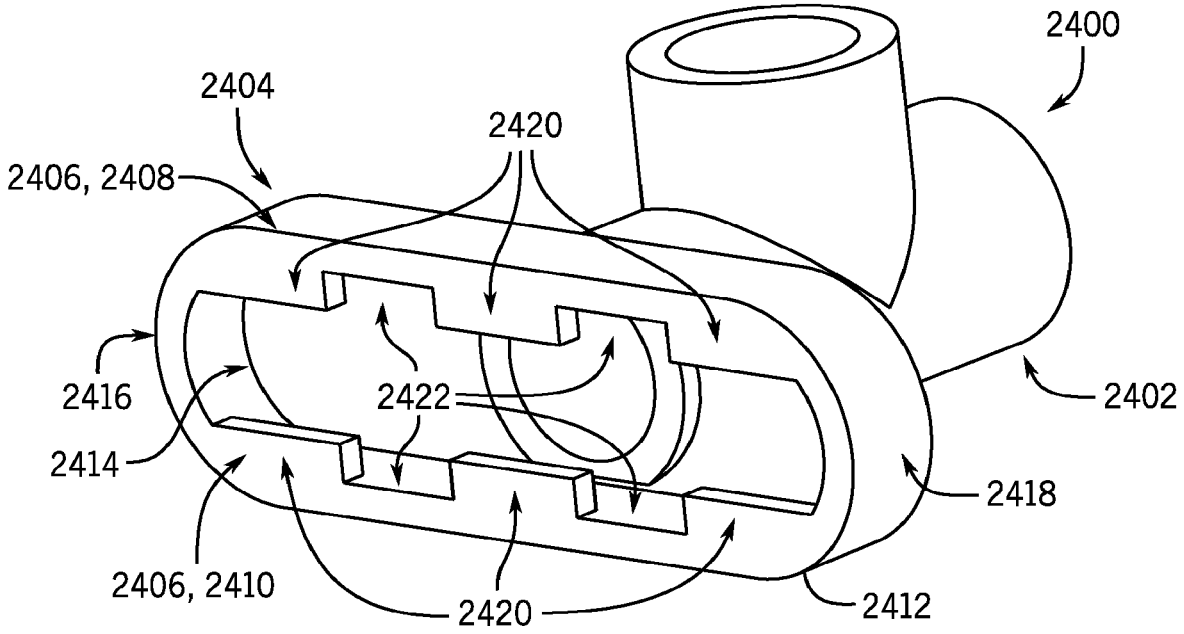
FIG. 24 is a perspective view of portions of an additional improved faucet apparatus, including a body portion and a base portion, in accordance with a second example embodiment encompassed herein.

In addition to the above-described embodiments and implementations, the present disclosure is also intended to encompass numerous other alternate embodiments and implementations as well. For example, a first alternate (second) embodiment of a faucet employs faucet portions 2400 including a faucet body 2402 and a faucet base 2404 as shown in FIG. 24. In this embodiment, the faucet body 2402 can be identical or substantially identical to the faucet body 302. As for the faucet base 2404, although it is largely identical to the base 304, the faucet base 2404 differs from the faucet base 304 in that the faucet base 2404 has rail (or undercut) structures 2406 instead of the inwardly-facing surfaces 342, 344, 346, and 348 that define the first, second, and third holes 336, 338, and 340 in the faucet base 304. The rail structures 2406 constitute part of a mounting surface 2412 of the faucet base 2404, which corresponds to the mounting surface 330 of the faucet base 304 and is the portion of the faucet base that contacts a support surface such as the vertical sink wall surface 206 or horizontal surface 1902 mentioned above when the faucet is mounted on a sink basin arrangement.

In the present embodiment, the rail structures 2406 particularly include a first rail structure 2408 and a second rail structure 2410 that are arranged along opposite sides of a central orifice 2414 formed within the mounting surface 2412. As in the case of the faucet base 304, the faucet base 2404 is an oblong structure extending between a first end 2416 and a second end 2418 (corresponding to the first end 326 and second end 328 of the faucet base 304) and, correspondingly, the central orifice 2414 is a substantially oblong structure having a length between the first and second ends that is greater than its width. As illustrated, the first rail structure 2408 and second rail structure 2410 each extend between the first end 2416 and the second end 2418 of the faucet base 2404 and respectively jut inward toward one another into the central orifice 2414. In this embodiment, each of the first and second rail structures 2406 and 2408 particularly has a partly tooth-shaped appearance, insofar as each of the rail structures includes three jutting-in segments 2420 alternated with two spaces 2422 at which the rail structures do not extend inward into the central orifice 2414 (or do not extend inward to as great of a degree as do the jutting-in segments).

The faucet portions 2400 of FIG. 24 can be implemented in conjunction with several other faucet portions so as to arrive at a faucet that can in turn be installed in relation to any of a variety of sink basin arrangements (or possibly other support structures) including any of those discussed above with reference to FIGS. 3 to 23. In particular, the spout portion 500 and sensor structure portion 700 discussed above can be combined in relation to the faucet portions 2400 (and particularly in relation to first and second orifices of the faucet body 2402) in any of the manners discussed above in relation to FIGS. 3 to 23, including any of the manners discussed above in relation to the first, second, third, and fourth implementations 1000, 1400, 1700, and 2100.

Figure 25:
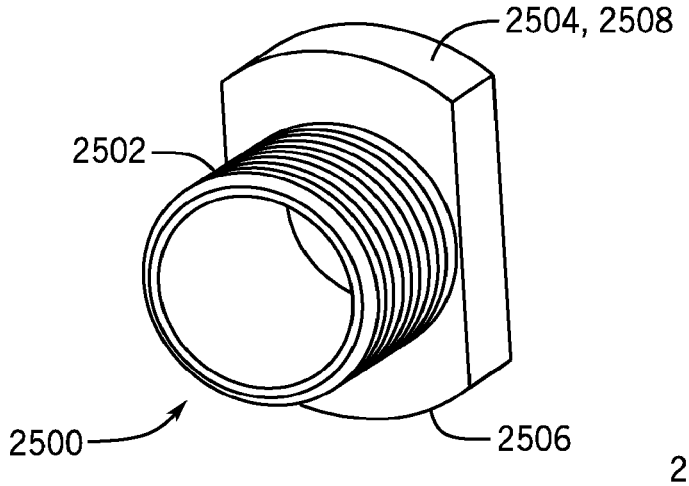
FIG. 25 is a perspective view of a threaded stud portion of the additional improved faucet apparatus of FIG. 24.

In contrast to the faucet of FIGS. 3 to 23, however, the presence of the rail structures 2406 along the mounting surface 2412 of the faucet base 2404 allows the faucet to be implemented in somewhat different manners relative to sink basin arrangements (or other support structures) than as discussed above in regard to FIGS. 3 to 23. Rather than being implemented by way of one or more of the threaded sleeve(s) 900, instead the faucet employing the faucet portions 2400 with the rail structures 2406 is implemented by way of one or more threaded stud portion(s) 2500, one of which is shown in FIG. 25. In this example embodiment, the threaded stud structure 2500 includes both a threaded sleeve section 2502 and also a plate 2504 attached to one of the ends of the threaded sleeve section. The threaded sleeve portion 2502 can have the same diameter, and same threading, as the threaded sleeve 900 of FIG. 9, but will typically have an axial length that is shorter than that of the threaded sleeve 900. The plate 2504 at one end of the threaded sleeve section 2502 particularly includes first and second extensions 2506 and 2508 that extend radially outward, in opposite directions, from the outer circumference of the end of the threaded sleeve portion.

Given the rail structures 2406 on the faucet base 2404, it will be appreciated that faucet implementations of the faucet employing the faucet portions 2400 can be mounted in relation to sink basin arrangements (or other support structures) as follows. In particular, depending upon the implementation, one or more (up to three) of the threaded stud portion(s) 2500 can be installed in relation to the faucet base 2404. This is achieved by inserting the respective end of each respective threaded stud portion 2500 having the plate 2502 into the interior of the faucet base 2404 so that the respective first and second extensions 2506 and 2508 (or vice-versa) are positioned inwardly of and behind opposed ones of the jutting-in segments 2420 of the first and second rail structures 2408 and 2410, respectively, and so that the threaded sleeve portion 2502 extends outwardly from the interior of the faucet base 2404 through the central orifice 2414. Insertion of the plate 2502 into the interior of the faucet base 2404 particularly can be accomplished by passing the first and second extensions 2506 and 2508 through opposed ones of the two spaces 2422.

As the first and second rail structures 2408 and 2410 each include three of the jutting-in segments 2420, up to three of the threaded stud portions 2500 can be installed at one time in relation to the faucet base 2404, with each respective one of the threaded stud portions ultimately being positioned behind a corresponding pair of the opposed jutting-in segments 2420. It should be appreciated that the particular number of the threaded stud portions 2500 that are installed in any given implementation will depend upon the configuration of the sink basin arrangement (or other support structure) in relation to which the faucet is being implemented, in the same manner as discussed above in regard to the implementation of one, two, or three of the threaded sleeves 900 for the purpose of mounting the faucet of FIGS. 3-23 in relation to sink basin arrangements having one, two, or three holes.

Figure 27:
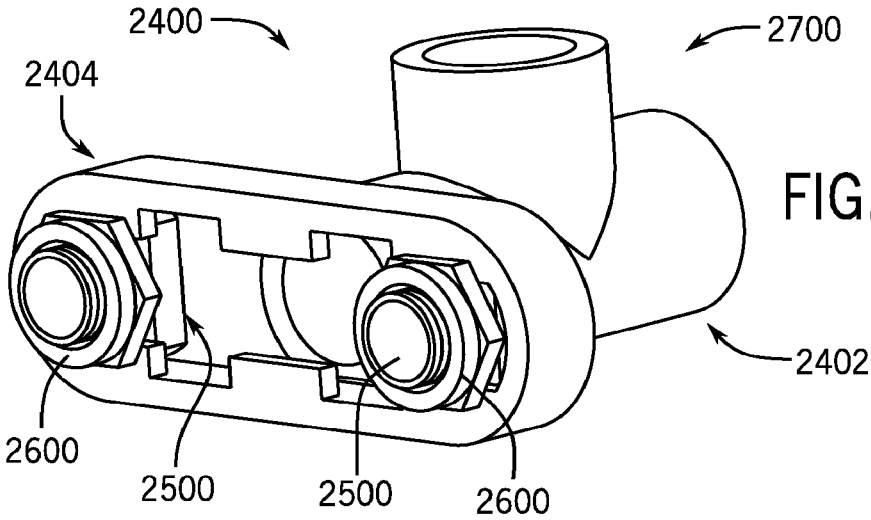
FIG. 27 is a perspective view of the portions of the additional improved faucet apparatus of FIG. 24, FIG. 25, and FIG. 26 (including multiple ones of the threaded stud portion and mounting nut of FIG. 25 and FIG. 26, respectively), assembled with one another.

After the appropriate number of the threaded stud portion(s) 2500 have been installed relative to the faucet base 2404, implementation of the faucet employing the faucet portions 2400 in relation to a sink basin arrangement (or other support structure) then entails inserting the threaded sleeve section(s) 2502 through corresponding hole(s) in the sink basin arrangement (or other support structure). After this is performed, the faucet is then secured to the sink basin arrangement (or other support structure) by attaching respective mounting nut(s) such as a mounting nut 2600 to each of the threaded sleeve section(s) With such an arrangement, the threaded stud portion(s) 2500 are then held to the faucet base 2404 therewithin by compression when the respective mounting nut(s) 2600 is or are torqued. So as to further illustrate such an implementation, FIG. 27 is additionally provided to show a combination structure 2700 in which the faucet portions 2400 are combined with two of the threaded stud portions 2500 and two of the mounting nuts 2600. It will be appreciated that FIG. 27 does not show a full implementation of the faucet in a manner resembling that of FIG. 12, insofar as neither a sink basin arrangement on which the faucet is installed, nor any of the spout portion 500, flow tube 602, or sensor structure portion 700 with the electrical cable 704, are shown. However, a full implementation of the faucet would include those portions/structures as well.

Figure 28:
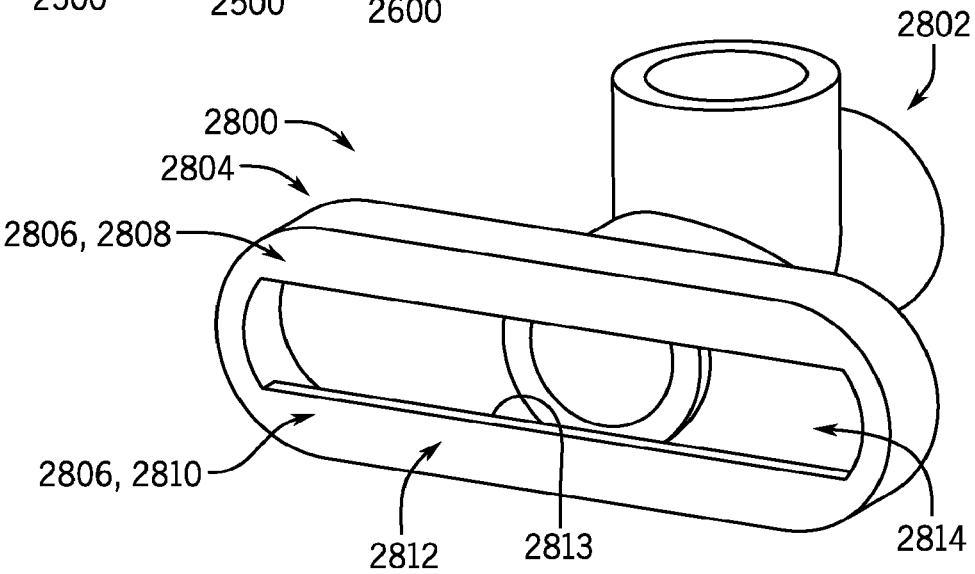
FIG. 28 is a perspective view of portions of an additional improved faucet apparatus, including a body portion and a base portion, in accordance with a third example embodiment encompassed herein.
Figure 29:
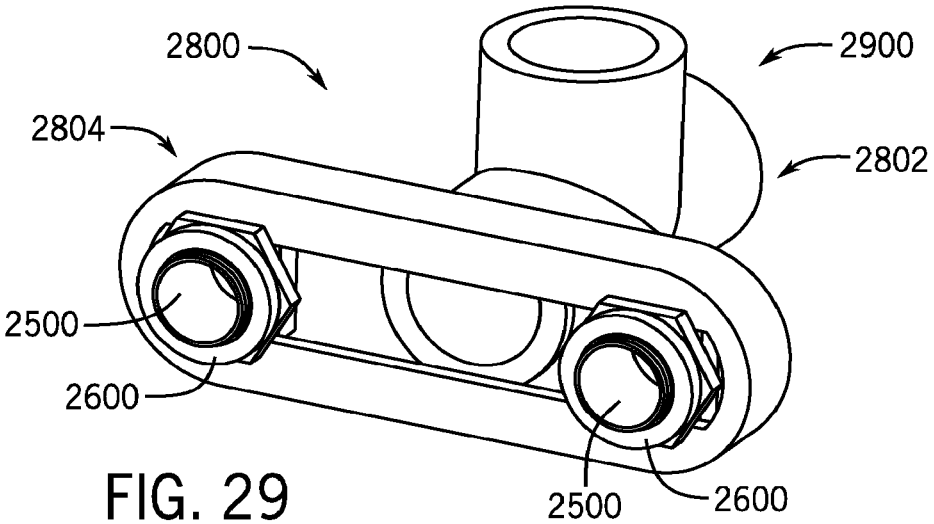
FIG. 29 is a perspective view of the portions of the additional improved faucet apparatus of FIG. 28, assembled together with multiple ones of the threaded stud portion and mounting nut of FIG. 25 and FIG. 26, respectively.

Referring next to FIG. 28 and FIG. 29, an additional alternate (third) embodiment of faucet can employ alternate faucet portions 2800 shown in FIG. 28. In this embodiment, the faucet portions 2800 are identical to the faucet portions 2400 except insofar as, instead of employing the faucet base 2404 having the first and second rail structures 2408 and 2410 as the rail structures 2406, the faucet portions 2800 employ a faucet base 2804 having first and second rail structures 2808 and 2810 as rail structures 2806 that are formed as part of a mounting surface 2812. As shown, the first and second rail structures 2808 and 2810 lack any of the spaces 2422, and consequently have uninterrupted linear edges 2813 that interface a central orifice 2814 of the faucet base 2804.

Figure 26:
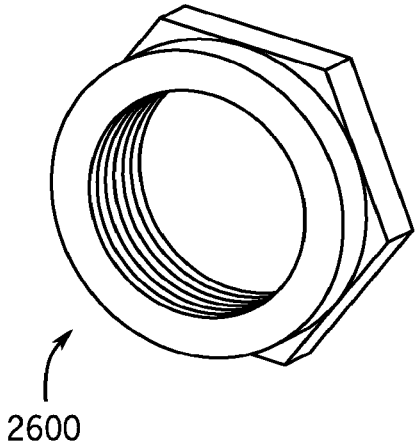
FIG. 26 is a perspective view of a mounting nut by which the additional improved faucet apparatus of FIG. 24 and FIG. 25 can be secured to a sink basin arrangement.

Given these features, a faucet employing the faucet portions 2800 (along with the spout portion 500, flow tube 602, and sensor structure portion 700) can still be implemented in relation to a sink basin arrangement (or other support structure) by way of one or more of the threaded stud portion(s) 2500 and mounting nut(s) 2600 of FIGS. 25 and 26. However, to achieve such an implementation, the one or more threaded stud portion(s) 2500 is or are inserted relative to the faucet base 2804 by passing the respective extensions 2506 and 2508 of the respective threaded stud portion(s) through the central orifice 2814 and then rotating the threaded stud portion(s) 90 degrees relative to the faucet base 2804 so that the extensions are positioned behind the rail structures 2806. So as to further illustrate such an implementation, FIG. 29 is additionally provided to show a combination structure 2900 in which the faucet portions 2800 are combined with two of the threaded stud portions 2500 and two of the mounting nuts 2600. It will be appreciated that FIG. 29 does not show a full implementation of the faucet in a manner resembling that of FIG. 12, insofar as neither a sink basin arrangement on which the faucet is installed, nor any of the spout portion 500, flow tube 602, or sensor structure portion 700 with the electrical cable 704, are shown.

Figure 30:
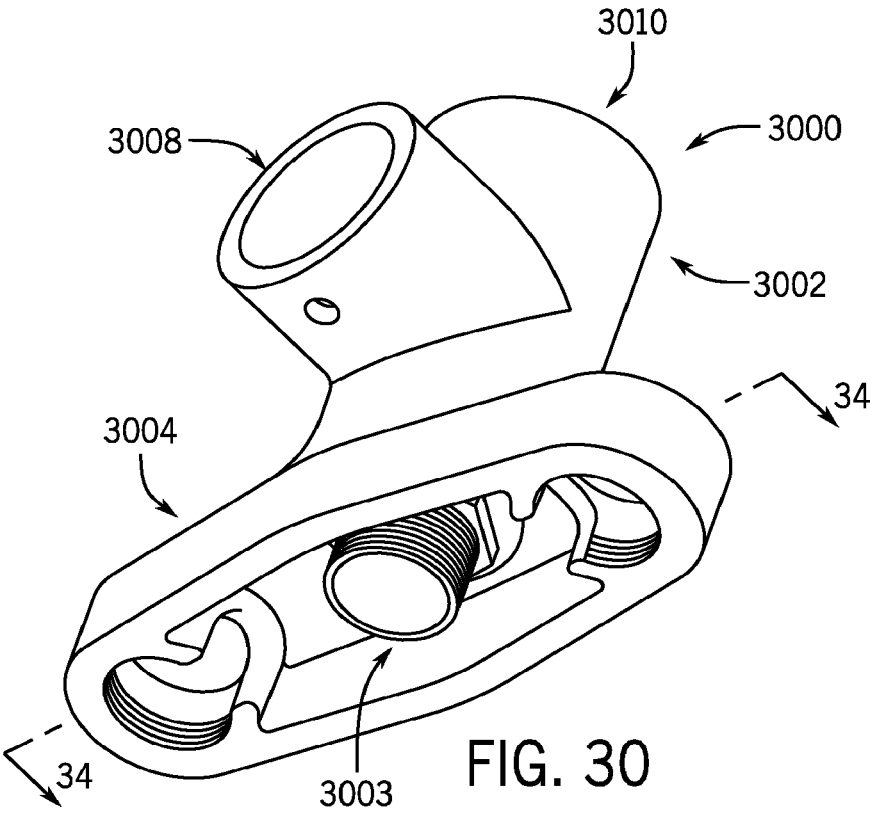
FIG. 30 is a perspective view of portions of an improved faucet apparatus, including a body portion and a base portion, in accordance with a fourth example embodiment encompassed herein.

Turning to FIG. 30, a further alternate (fourth) embodiment of faucet can employ alternate faucet portions 3000 shown in FIG. 30. In this embodiment, the faucet portions 3000 are identical to the faucet portions 300 except insofar as, instead of employing the faucet body 302 and faucet base 304 that are integrally formed with one another, instead the faucet portions 3000 include a faucet body 3002 and faucet body 3004 that are discrete and separable components that can be assembled relative to one another as shown in FIG. 30. More particularly in this regard, an additional perspective view is provided in FIG. 31 to show the faucet body 3002 by itself, and two alternative perspective views are provided in FIG. 32 and FIG. 33, respectively, to show the faucet base 3004 by itself.

Figure 31:
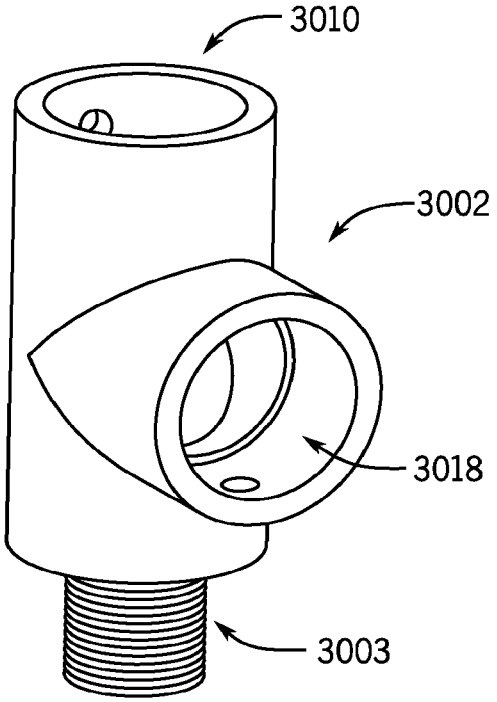
FIG. 31 is a perspective view of the body portion shown in FIG. 30.
Figure 32:
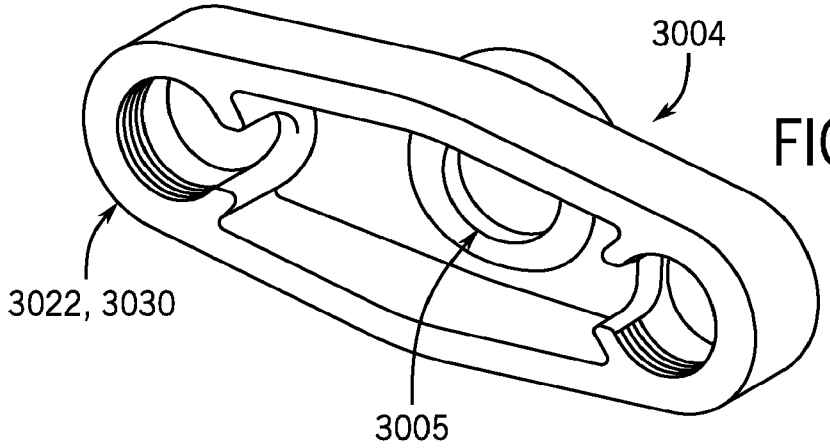
FIG. 32 and FIG. 33 are two different perspective views, respectively, of the base portion shown in FIG. 30.
Figure 33:
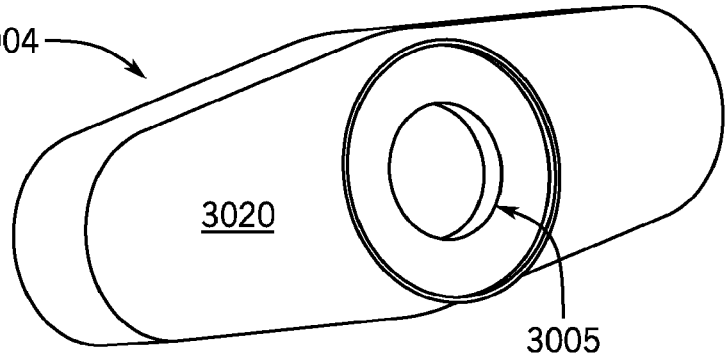
Figure 34:
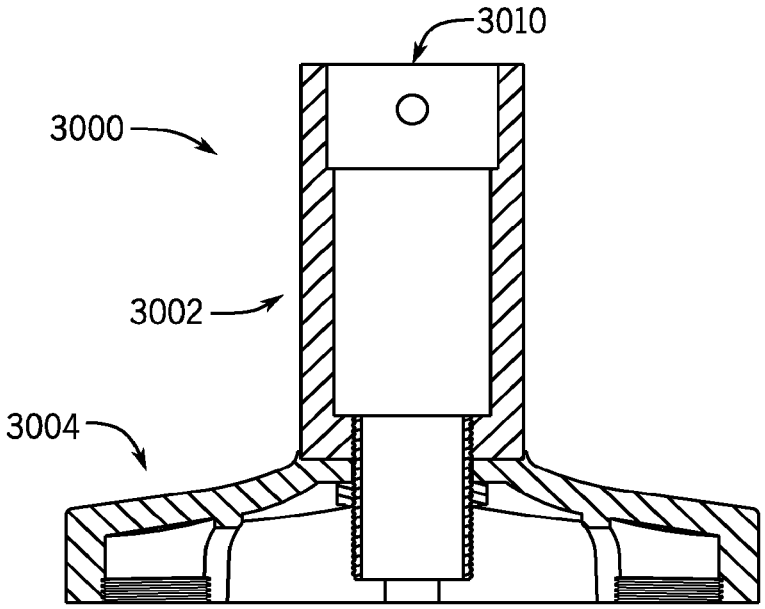
FIG. 34 is a cross-section of the portions of the improved faucet apparatus of FIGS. 30, 31, 32, and 33, taken along a line 34-34 of FIG. 30.

FIG. 31 particularly shows that the faucet body 3002 includes not only a first orifice 3010 and a second orifice 3018 respectively arranged in the same manner as the first orifice 310 and second orifice 318 are respectively arranged in relation to the faucet body 302, but also includes a threaded cylindrical extension 3003 extending outward away from the overall faucet body structure at an end opposite the position of the first orifice 3010. FIGS. 32 and 33 also show that the faucet base 3004 includes an additional threaded orifice 3005 at its center, along a first side 3020 of the faucet base opposite a second side 3022 of the faucet base along which is provided a mounting surface 3030 of the faucet base. It will be appreciated that the faucet body 3002 can be assembled to the faucet base 3004 by inserting the threaded cylindrical extension 3003 into the additional threaded orifice 3005 and rotating the faucet body relative to the faucet base. Such assembly results in the assembled faucet portions 3000, which are shown in FIG. 30 and also, in a cross-sectional view taken along a line 34-34 of FIG. 30, in FIG. 34.

It should again be appreciated, in relation to the faucet portions 3000 of FIGS. 30-34, that the faucet employing those faucet portions can be implemented in any of a variety of manners relative to a variety of sink basin arrangements (or other support structures), including implementations corresponding to the first, second, third, and fourth implementations 1000, 1400, 1700, and 2100 discussed above (and possibly employing any of one, two, or three threaded sleeve(s) 900 to suit sink basin arrangements having one, two, or three holes). The faucet body 3002 can support interchangeable spout and sensor structure portions (such as the spout portion 500 with the flow tube 602 and the sensor structure portion 700) even though the cylindrical extension 3003 includes essentially a single hole base. The separate faucet base 3004 (which can also be considered a separate adaptor) can be installed on the bottom of the faucet body and can accommodate any of the 2 and 3-hole (or possibly single hole) applications and allow tube(s)/wire(s) such as the flow tube 602 and electrical cable 704 to be routed through the base to the faucet body.

Figure 36:
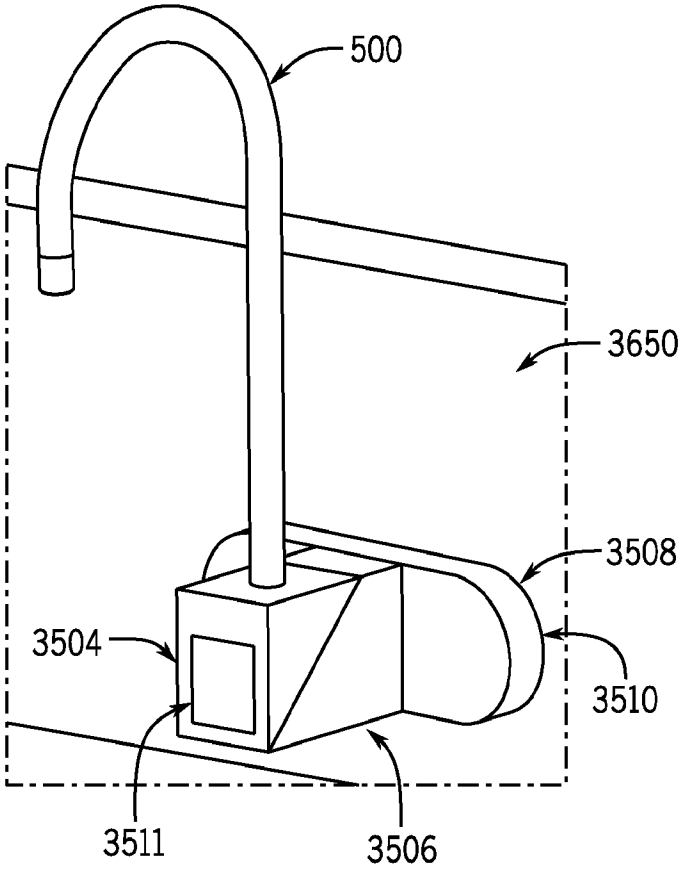
FIG. 36 is a front perspective view of a second implementation of the additional improved faucet apparatus of FIG. 35, mounted in relation to a backsplash mount sink basin arrangement, which is shown in cutaway.
Figure 35:
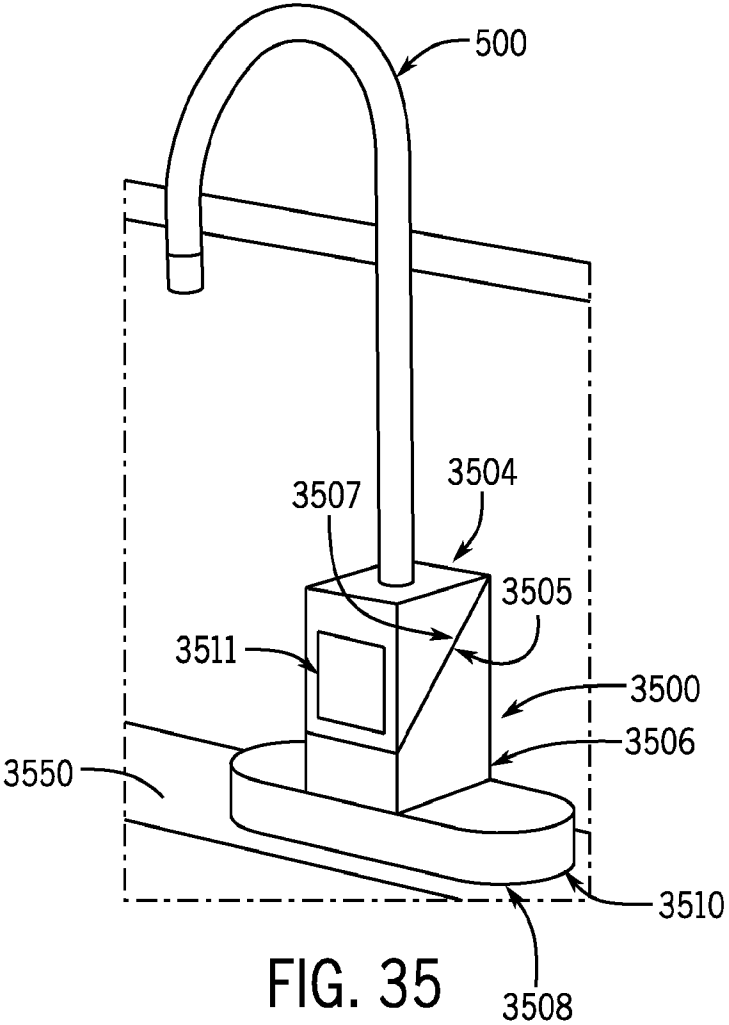
FIG. 35 is a front perspective view of a first implementation of an additional improved faucet apparatus, in accordance with a fifth example embodiment encompassed herein, mounted in relation to a deck mount sink basin arrangement, which is shown in cutaway.

Referring to FIGS. 35 and 36, the present disclosure also encompasses a further alternate (fifth) embodiment of faucet. In this embodiment, the faucet includes a faucet structure 3500 including a first faucet body portion 3504 having a first 45 degree mating surface 3505 and a second faucet body portion 3506 having a second 45 degree mating surface 3507. In the present embodiment, the second faucet body portion 3506 also includes a fully-integrated faucet base 3508. The faucet base 3508 has a mounting surface 3510 that is intended to be in contact with a corresponding mounting surface of a sink basin arrangement or other support structure in relation to which the faucet is to be implemented. Also, the first faucet portion 3504 includes first and second orifices into which the spout portion 500 (or another spout portion) and a sensor structure portion 3511 (in this case, shown to be rectangular) can be mounted.

In this embodiment, the first and second faucet body portions 3504 and 3506 are respectively configured to include the first and second 45 degree mating surfaces 3505 and 3507, respectively. Additionally, the first and second faucet body portions 3504 and 3506 are configured so as to be assembled to, and in contact with, one another by positioning the two mating surfaces 3505 and 3507 in contact with one another. By virtue of the 45 degree angle of the two mating surfaces 3505 and 3507, the first faucet portion 3504 particularly can be positioned relative to the second faucet portion 3506 in either of two positions that are 90 degrees relative to another.

By virtue of this capability, the faucet can take on numerous implementations, two of which are illustrated in FIG. 35 and FIG. 36, respectively. More particularly, as illustrated by FIG. 35, the first and second faucet body portions 3504 and 3506 can be assembled so that the faucet base 3508 is directly in line with (e.g., 180 degrees apart from) the first orifice from which the spout portion 500 protrudes, which would be suitable for mounting the faucet atop a horizontal rim surface 3550 of a deck mount sink basin arrangement. Alternatively, as illustrated by FIG. 36, the first and second faucet body portions 3504 and 3506 can be assembled so that the faucet base 3508 is perpendicular to (e.g., 90 degrees relative to) the first orifice from which the spout portion 500 protrudes, which would be suitable for mounting the faucet atop a horizontal rim surface 3650 of a backsplash mount sink basin arrangement.

Notwithstanding the above description, the present disclosure is intended to encompass additional embodiments and modified versions of the above-described embodiments in addition to the embodiments specifically described above. For example, although the first orifice 310 and second orifice 318 are described as cylindrical, the present disclosure is intended to encompass alternate embodiments having pairs (or more than two) of orifices with identical shapes and sizes that are different from the shape and size of the first orifice 310 and second orifice 318. Further for example, in some such embodiments, faucet body portions can include pairs of orifices that each share a square or rectangular, or triangular, or oval, shape. Additionally, although the above description includes numerous arrangements in which portions, components, or features are described as being perpendicular (or 90 degrees relative to) to, opposite of, in line with, or otherwise arranged in particular geometric orientations relative to one another (e.g., 45 degrees relative to one another), the present disclosure is intended to encompass additional embodiments that entail other geometric arrangements, including arrangements that are substantially similar to, but not identical to, those described above (e.g., 75 or 80 degrees rather than 90 degrees).

It is specifically intended that the present invention not be limited to the embodiments and illustrations contained herein, but include modified forms of those embodiments including portions of the embodiments and combinations of elements of different embodiments as come within the scope of the following claims.

We claim:

1. A faucet apparatus comprising:

a base having a mounting surface;

a body integrated or coupled to the base, wherein the body includes first and second surfaces, respectively, within which are formed first and second orifices, respectively, wherein the first and second orifices respectively extend inward into the body along a first axis and a second axis, respectively, and the first axis is perpendicular or substantially perpendicular relative to the second axis, and wherein a first cross-section of the first orifice taken perpendicular to the first axis has a first size and a first shape that are, respectively, substantially identical to a second size and a second shape of a second cross-section of the second orifice taken perpendicular to the second axis;

a spout having a first end that is configured to fit complementarily within either of the first and second orifices, and that is supported within the first orifice;

a first structure having an external cross-sectional surface that also is configured to fit complementarily within either of the first and second orifices, and that is supported within the second orifice.

2. The faucet apparatus of claim 1, wherein either the first axis or the second axis extends in a manner that is normal or substantially normal to a plane along which the mounting surface extends or substantially extends.

3. The faucet apparatus of claim 2, wherein the second axis is normal or substantially normal to the mounting surface.

4. The faucet apparatus of claim 3, wherein the first axis extends vertically or substantially vertically and the first surface faces substantially upward, wherein the second axis extends horizontally or substantially horizontally, and wherein the second surface faces substantially forward and away from a location of the mounting surface, which faces substantially rearward.

5. The faucet apparatus of claim 2, wherein the first axis is normal or substantially normal to the mounting surface.

6. The faucet apparatus of claim 5, wherein the first axis extends vertically or substantially vertically, wherein the first surface faces substantially upward and away from a location of the mounting surface, which faces substantially downward, and wherein the second axis extends horizontally or substantially horizontally and the second surface faces substantially forward.

7. The faucet apparatus of claim 1, wherein the first structure is a sensor structure that includes a proximity sensor that is an infrared sensor or includes a proximity sensor adapter, and wherein each of the first and second orifices is substantially cylindrical.

8. The faucet apparatus of claim 1, wherein the base includes at least one receiving orifice that is at least partly surrounded by or defined by the mounting surface.

9. The faucet apparatus of claim 8, wherein the at least one receiving orifice includes at least a first receiving orifice and a second receiving orifice that are respectively positioned on first and second opposed sides of a center region of the base.

10. The faucet apparatus of claim 9, wherein the at least one receiving orifice includes a third receiving orifice positioned at the center region.

11. The faucet apparatus of claim 9, wherein the first receiving orifice is defined at least partly by a first interior surface that is substantially cylindrical and that is threaded, and wherein the second receiving orifice is defined at least partly by a second interior surface that also is substantially cylindrical and that is threaded.

12. The faucet apparatus of claim 11, further comprising first and second cylindrical inserts, wherein the first cylindrical insert is partly inserted and supported within the first interior surface and the second cylindrical insert is partly inserted and supported within the second interior surface, and wherein each of the first and second cylindrical inserts is threaded along a respective outer surface thereof in a first manner that is complementary to a second manner in which each of the first and second interior surfaces is threaded.

13. The faucet apparatus of claim 12, further comprising first and second nuts that are configured so that, when the first cylindrical insert is additionally positioned through a first additional orifice in a support structure, the first nut can be attached at or proximate to a first end of the first cylindrical insert that has passed through the first additional orifice, and when the second cylindrical insert is additionally positioned through either the first additional orifice or a second additional orifice in the support structure, the second nut can be attached at or proximate to a second end of the second cylindrical insert that has passed through the first or second additional orifice.

14. The faucet apparatus of claim 13, wherein the first interior surface that is threaded extends inwardly a first distance from the plane into an interior of the base up to a first inner region, wherein the second interior surface that is threaded extends inwardly either the first distance or a second distance from the plane into the interior of the base up to a second inner region, and wherein the base includes a first channel linking the first inner region with the center region, and includes a second channel linking the second inner region with the center region, and wherein the first and second channels are configured to permit at least one tube to be passed from one or both of the first and second cylindrical inserts to the center region.

15. The faucet apparatus of claim 8, wherein the base includes a body-facing surface that is integrated with or coupled to the body, and a plurality of walls that extend from the body-facing surface to the plane, wherein an interior region within the base is defined at least in part by the plurality of walls, and wherein the base additionally includes two lip portions that extend inwardly into the interior region within the base respectively from two of the walls that are opposed relative to one another, such that the two lip portions extend toward one another, but not up to one another, and at least partly define either the at least one receiving orifice or an additional orifice adjacent to the at least one receiving orifice.

16. The faucet apparatus of claim 15, further comprising an insert having a tubular section extending between first and second ends and having at least one flange at the first end, the at least one flange including a first flange portion and a second flange portion extending in opposite directions outward away from the tubular section, perpendicular or substantially perpendicular to a tubular axis of the tubular section, wherein the insert is positioned so that the first and second flange portions are positioned within the interior region of the base so as to be supported upon the two lip portions and so that the tubular section extends between the two lip portions toward and beyond the plane.

17. A method of implementing a faucet apparatus, the method comprising:

providing a plurality of components of the faucet apparatus, including a base, a body, a spout, and a first structure, wherein the body is integrated or coupled to the base, wherein the base includes a mounting surface, and the body includes first and second surfaces, respectively, within which are formed first and second orifices, respectively, wherein the first and second orifices respectively extend inward into the body along a first axis and a second axis, respectively, and the first axis is perpendicular or substantially perpendicular relative to the second axis, wherein a first cross-section of the first orifice taken perpendicular to the first axis has a first size and a first shape that are, respectively, substantially identical to a second size and a second shape of a second cross-section of the second orifice taken perpendicular to the second axis, wherein the spout has a first end that is configured to fit complementarily within either of the first and second orifices, and wherein the first structure has an external cross-sectional surface that also is configured to fit complementarily within either of the first and second orifices;

determining whether a second structure in relation to which the mounting surface is to be in contact and supported includes a horizontally-extending support surface or a vertically-extending support surface; and either:

a) if the second structure includes the horizontally-extending support surface, inserting the first end into the first orifice and inserting the first structure into the second orifice; or b) if the second structure includes the vertically-extending support surface, inserting the first end into the second orifice and inserting the first structure into the first orifice, whereby the faucet apparatus can be implemented in either of two manners so that the first structure is forward-facing, or substantially forward-facing, regardless of whether the second structure includes the horizontally-extending support surface or the vertically-extending support surface.

18. The method of claim 17, further comprising:

installing a first insert partly into an interior region of the base so that the first insert is supported relative to the base and extends partly out of the base beyond a plane along which at least part of the mounting surface extends or substantially extends;

causing the mounting surface to contact either the vertically-extending support surface or the horizontally-extending support surface of the second structure so that an end portion of the first insert at least partly extends through an orifice of the second structure; and affixing a fastening component to the end portion of the first insert so as to secure the faucet apparatus to the second structure.

19. The method of claim 18, wherein the first structure is a sensor structure, wherein the insert is a tubular insert, and further comprising:

inserting at least one tube through the tubular insert or a second insert additionally installed into the interior region, so that the at least one tube extends from an exterior location to the spout or to the sensor structure, wherein the at least one tube is capable of communicating one or both of water to the spout or electric power to the sensor structure to permit operation of the faucet apparatus.

20. A faucet apparatus comprising:

a spout;

a structure having an axis associated therewith;

a base including a mounting surface that extends at least partly along a plane; and means for enabling the spout and the structure to be supported in relation to the base in either of a first manner or a second manner, wherein when the spout and the structure are supported in relation to the base in the first manner, the axis is normal or substantially normal relative to the plane and, when the spout and the structure are supported in relation to the base in the second manner, the axis is parallel or substantially parallel to the plane.

* * * * *